US009442418B2

(12) United States Patent
Kawamoto et al.

(10) Patent No.: US 9,442,418 B2
(45) Date of Patent: Sep. 13, 2016

(54) DEVELOPING DEVICE, PROCESS CARTRIDGE AND IMAGE FORMING APPARATUS

(71) Applicant: CANON KABUSHIKI KAISHA, Tokyo (JP)

(72) Inventors: Takahiro Kawamoto, Yokohama (JP); Kazuhisa Kemmochi, Suntou-gun (JP); Masayoshi Kato, Tokyo (JP); Makoto Fukatsu, Suntou-gun (JP); Atsushi Nakamoto, Tokyo (JP); Kazunari Hagiwara, Yokohama (JP); Yasunori Chigono, Atsugi (JP); Shuhei Tokiwa, Tokyo (JP); Takeshi Yamamoto, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/882,612

(22) Filed: Oct. 14, 2015

(65) Prior Publication Data

US 2016/0109824 A1 Apr. 21, 2016

(30) Foreign Application Priority Data

Oct. 20, 2014 (JP) ..... 2014-214070
Aug. 18, 2015 (JP) ..... 2015-161353

(51) Int. Cl.
*G03G 15/08* (2006.01)

(52) U.S. Cl.
CPC ..... *G03G 15/0812* (2013.01)

(58) Field of Classification Search
CPC ..... G03G 15/0812; G03G 15/0806
See application file for complete search history.

(56) References Cited

U.S. PATENT DOCUMENTS

| | | | |
|---|---|---|---|
| 5,710,965 | A | 1/1998 | Nozawa et al. |
| 6,173,144 | B1 | 1/2001 | Hirabayashi et al. |
| 6,229,980 | B1 | 5/2001 | Ogawa et al. |
| 6,278,856 | B1 | 8/2001 | Yamamoto |
| 6,654,575 | B2 | 11/2003 | Miura et al. |
| 7,031,629 | B2 | 4/2006 | Kawamura et al. |
| 7,072,607 | B2 | 7/2006 | Haraguchi et al. |
| 7,233,758 | B2 | 6/2007 | Osada et al. |
| 7,251,441 | B2 | 7/2007 | Hagiwara et al. |

(Continued)

FOREIGN PATENT DOCUMENTS

| | | | |
|---|---|---|---|
| JP | S64-057278 | A | 3/1989 |
| JP | H08-069171 | A | 3/1996 |

*Primary Examiner* — Gregory H Curran
(74) *Attorney, Agent, or Firm* — Fitzpatrick, Cella, Harper & Scinto

(57) ABSTRACT

A developing device includes: a developing container for accommodating developer, a developer carrying member, and a plate-like elastic member. In a state in which the elastic member contacts the developer carrying member without being deformed, an angle formed between a flat reference surface passing through a surface of the elastic member which is continuous to a contact portion of the elastic member with the developer carrying member and which is downstream of the contact portion with respect to the movement direction and a tangent plane of the developer carrying member and a contact position between the elastic member and the developer carrying member is 10° or more and 45° or less, and the elastic member includes a first region including the contact portion and a second region which is provided continuously from the first region toward the supporting portion and which is lower in rigidity than the first region.

57 Claims, 10 Drawing Sheets

(56) References Cited

U.S. PATENT DOCUMENTS

| | | | | |
|---|---|---|---|---|
| 7,379,693 | B2 | 5/2008 | Ogawa et al. | |
| 7,657,213 | B2 * | 2/2010 | Baker | G03G 15/0812 399/284 |
| 7,773,923 | B2 | 8/2010 | Hagiwara et al. | |
| 9,026,011 | B2 | 5/2015 | Kubo et al. | |
| 9,134,649 | B2 | 9/2015 | Orihara et al. | |
| 2005/0208406 | A1 * | 9/2005 | Nozawa | G03G 9/09725 430/108.6 |
| 2010/0158564 | A1 * | 6/2010 | Nakamura | G03G 15/0818 399/111 |
| 2012/0269545 | A1 * | 10/2012 | Morita | G03G 21/1825 399/111 |
| 2015/0132030 | A1 | 5/2015 | Orihara et al. | |

* cited by examiner

DEVELOPING DEVICE, PROCESS CARTRIDGE AND IMAGE FORMING APPARATUS

FIELD OF THE INVENTION AND RELATED ART

The present invention relates to a developing device and a process cartridge which are used in an image forming apparatus, such as a copying machine or a printer, of an electrophotographic type or an electrostatic recording type, and relates to the image forming apparatus.

The image forming apparatus of the electrophotographic type or the like includes the developing device for developing an electrostatic latent image, formed on an image bearing member, with a developer. With respect to the developing device, various constitutions have been proposed depending on species of the developer used, but as one of the constitutions, there is a one-component developing type using a one-component developer (hereinafter also referred to as a toner). The developing device of the one-component developing type includes a developer carrying member for carrying and feeding the toner and a regulating member for regulating the toner carried by the developer carrying member to form a thin layer in general.

For example, a developing device in which a regulating member formed with a thin metal plate and a developer carrying member formed a rubber material are provided and in which a free end portion of the thin metal plate in a free end side contacts the developer carrying member in a state is directed toward an upstream side with respect to a movement direction is disclosed (Japanese Laid-Open Patent Application Hei 8-69171). In such a constitution, the toner carried on the developer carrying member is triboelectrically charged together with layer thickness regulation by a regulating member and develops the electrostatic latent image formed on the image bearing member.

However, when the developing device is used for a long term, by sliding between the regulating member and the developer carrying member through the toner, a contact portion of the regulating member with the developer carrying member is gradually abraded, so that a contact state between the regulating member and the developer carrying member changes. Specifically, a shape of the contact portion of the regulating member is changed by abrasion, so that not only a contact region between the regulating member and the developer carrying member extends but also a press-contact force acting on regulation of a layer thickness of the toner lowers. As a result, it becomes difficult to stably regulate the toner layer thickness, so that image inconvenience such as a density fluctuation is generated in some cases.

In view of this problem, a constitution in which only an edge portion of a regulating member formed with a flat-plate elastic member or a plane (in a downstream side with respect to a movement direction of the developer carrying member) including the edge portion contacts the developer carrying member is proposed (Japanese Laid-Open Patent Application Sho 64-57278). According to this constitution, a contact region between the regulating member and the developer carrying member becomes narrow, and therefore a change in contact state due to the abrasion is easily reduced.

However, in the case where the developing device is used for a long term, also a change in toner characteristic or the like generates together with the abrasion of the regulating member, and therefore in order to stably regulate the toner layer thickness, there is a need to increase the press-contact force of the regulating member against the developer carrying member to a sufficiently high value and to maintain the increased press-contact force. However, in the constitution as in Japanese Laid-Open Patent Application Sho 64-57278, as the press-contact force of the regulating member is increased in order to regulate the toner layer thickness, the contact region between the regulating member and the developer carrying member is liable to extend due to elastic deformation of the regulating member. Therefore, in the case where the developing device is used for a long term, it becomes difficult to stably regulate the toner layer thickness in some cases.

SUMMARY OF THE INVENTION

According to an aspect of the present invention, there is provided a developing device comprising: a developing container for accommodating developer; a developer carrying member, provided rotatably in the developing container, for carrying and feeding the developer; and a plate-like elastic member, supported by the developing container, for regulating the developer carried on the developer carrying member, wherein a free end portion of the elastic member in a free end side opposite from a side where a supporting portion of the elastic member is supported by the developing container contacts the developer carrying member in a state in which the free end portion is directed toward an upstream side of the developer carrying member with respect to a movement direction of the developer carrying member, wherein an angle formed between a reference surface passing through a surface of the elastic member which is continuous to a contact portion of the elastic member with the developer carrying member and which is downstream of the contact portion with respect to the movement direction and a tangent plane of the developer carrying member under no load at a contact position between the elastic member and the developer carrying member is 10° or more and 45° or less, and wherein the elastic member includes a first region including the contact portion and a second region which is provided continuously from the first region toward the supporting portion and which is lower in rigidity than the first region, the second region being provided downstream of the reference surface with respect to the movement direction.

According to another aspect of the present invention, there is provided a process cartridge detachably mountable to a main assembly of an image forming apparatus, comprising an image bearing member on which an electrostatic latent image, and the above-described developing device.

According to another aspect of the present invention, there is provided an image forming apparatus for forming an image on a recording material, comprising an image bearing member on which an electrostatic latent image, and the above-described developing device.

According to a further aspect of the present invention, there is provided an image forming apparatus for forming an image on a recording material, comprising the above-described process cartridge.

These and other objects, features and advantages of the present invention will become more apparent upon a consideration of the following description of the preferred embodiments of the present invention taken in conjunction with the accompanying drawings.

DESCRIPTION OF THE EMBODIMENTS

Hereinbelow, embodiments of the present invention will be specifically described with reference to the drawings. However, dimensions, materials and shapes of constituent elements and their relative arrangements and the like described in the following embodiments should be changed appropriately depending on structures and various conditions of apparatuses (devices) to which the present invention is applied, and the scope of the present invention is not intended to be limited to the following embodiments.

<Embodiment 1>

1. General Structure and Operation of Image Forming Apparatus

Figure 1:
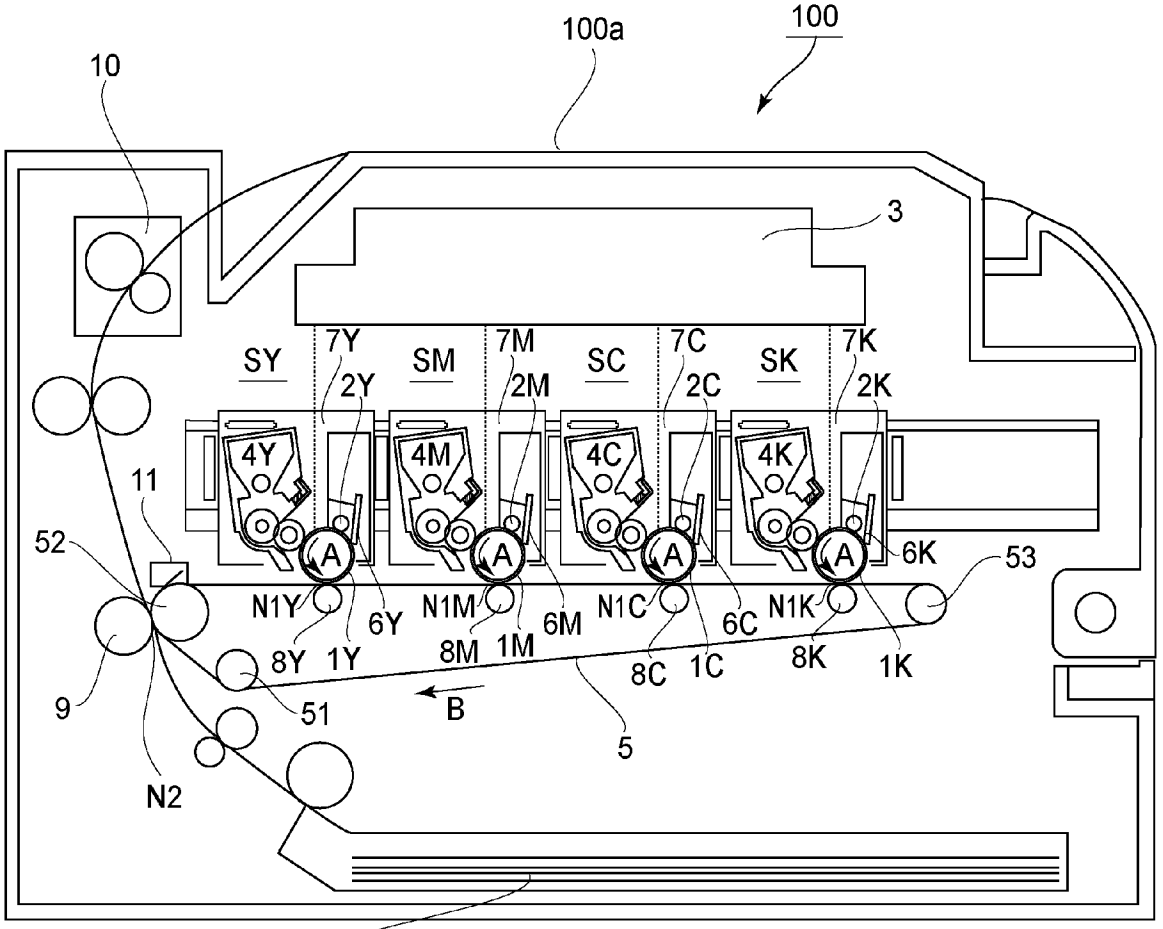
FIG. 1 is a schematic sectional view of an image forming apparatus in Embodiment 1 of the present invention.

First, a general structure of the image forming apparatus in this embodiment will be described. FIG. 1 is a schematic sectional view of an image forming apparatus 100 in this embodiment. The image forming apparatus 100 in this embodiment is an electrophotographic full-color laser beam printer (electrophotographic image forming apparatus) employing an in-line type and an intermediary transfer type, and is capable of forming a full-color image, in accordance with image information, on a recording material 12 such as a recording sheet, a plastic sheet or cloth. The image information is inputted into an apparatus main assembly 100*a* from a host developing unit such as a personal computer communicatably connected with the image forming apparatus 100.

The image forming apparatus 100 includes, as a plurality of image forming portions, first to fourth image forming portions SY, SM, SC and SK for forming images of colors of yellow (Y), magenta (M), cyan (C) and black (K), respectively. In this embodiment, the image forming portions SY, SM, SC and SK are arranged in line in a horizontal direction.

In this embodiment, constitutions and operations of the image forming portions are substantially the same except that the colors of the images to be formed (toners to be used) are different from each other. Accordingly, in the following description, in the case where the image forming portions are not particularly required to be distinguished from each other, suffixes Y, M, C and K added to reference numerals for representing elements for the associated colors are omitted, and the elements for the associated colors will be collectively described. In this embodiment, the image forming portion S is constituted by a photosensitive drum 1, a charging roller 2, a scanner unit 3, a developing unit 4, a primary transfer roller 8, a cleaning member 6 and the like.

The image forming apparatus 100 includes the photosensitive drum 1 which is a drum-type (cylindrical) electrophotographic photosensitive member as an image bearing member. The four photosensitive drums 1Y, 1M, 1C and 1K are juxtaposed in a direction crossing the vertical direction. The photosensitive drum 1 is rotationally driven in an indicated arrow A direction (counterclockwise direction at a predetermined circumferential speed by an unshown driving motor as a driving means (driving source). At a periphery of the photosensitive drum 1, the charging roller 2 as a charging means, the scanner unit 3 as an exposure means, the developing unit (developing device) 4 and the cleaning member 6 as a cleaning means are disposed. The charging roller 2 electrically charges the surface of the photosensitive drum 1 uniformly to a predetermined polarity and a predetermined potential. The scanner unit 3 emits laser light on the basis of the image information inputted from a host computer (not shown), so that an electrostatic latent image (electrostatic image) is formed on the uniformly charged surface of the photosensitive drum 1. The developing unit 4 includes a non-magnetic one-component developer (toner) as a developer, and develops (visualized) the electrostatic latent image into a toner image. In the developing units 4Y, 4M, 4C and 4K for the respective colors, the toners of colors of yellow (Y), magenta (M), cyan (C) and black (K), respectively, are accommodated. The cleaning member 6 removes a transfer residual toner remaining on the photosensitive drum 1 after transfer.

The image forming apparatus 100 includes an intermediary transfer belt 5 as an intermediary transfer member disposed opposed to the four photosensitive drums 1Y, 1M, 1C, 1K which are provided in parallel. The intermediary transfer belt 5 carries and conveys the toner image for transferring the toner image from the photosensitive drum 1 onto the recording material 12. The intermediary transfer belt 5 is formed with an endless belt, and is extended and stretched around a driven roller 51, a secondary transfer opposite roller 52 and a driving roller 53. The intermediary transfer belt 5 contacts all of the photosensitive drums 1 at an outer peripheral surface thereof. The intermediary transfer belt 5 is moved (rotated) and circulated in an indicated arrow B direction (clockwise direction) at a predetermined peripheral speed by rotationally driving the driving roller 53 with an unshown driving motor as a driving means (driving source) is connected. In an inner peripheral surface side of the intermediary transfer belt 5, four primary transfer rollers 8Y, 8M, 8C, 8K as a primary transfer means are juxtaposed so as to oppose the photosensitive drums 1Y, 1M, 1C, 1K, respectively. Each of the primary transfer rollers 8 toward the photosensitive drum 1 via the intermediary transfer belt 5 is urged to form a primary transfer portion N1 where the intermediary transfer belt 5 and the photosensitive drum 1 contact each other. In an outer peripheral surface side of the intermediary transfer belt 5, a secondary transfer roller 9 as a secondary transfer means is provided at a position opposing the secondary transfer opposite roller 52. The secondary transfer roller 9 is urged toward the secondary transfer opposite roller 52 via the intermediary transfer belt 5 to form a secondary transfer portion N2 where the intermediary transfer belt 5 and the secondary transfer roller 9 contact each other. In a region of the intermediary transfer belt 5 opposing the secondary transfer roller opposite roller 52 in the outer peripheral surface side, at a position downstream of the secondary transfer portion N2 with respect to a movement direction of the intermediary transfer belt 5, an intermediary transfer belt cleaning device 11 for cleaning the intermediary transfer belt 5 is provided.

The image forming apparatus 100 includes a fixing device 10 including a fixing roller and a pressing roller in a side downstream of the secondary transfer portion N2 with respect to a feeding direction of the recording material 12.

In this embodiment, the photosensitive drum 1 acts as process means actable on the photosensitive drum 1, the charging roller 2, the developing unit 4 and the cleaning member 6 are integrally assembled into a cartridge to form a process cartridge 7. The process cartridge 7 is detachably mountable to the apparatus main assembly 100*a* of the image forming apparatus 100 via mounting means such as a mounting guide, a positioning member and the like which are provided in the apparatus main assembly of the image forming apparatus 100. In this embodiment, all of the process cartridges 7 for the respective colors have the same shape.

Here, the electrophotographic image forming apparatus forms the image on the recording material by using the electrophotographic image forming process. Examples of the electrophotographic image forming apparatus may include an electrophotographic copying machine, an electrophotographic printer (a laser beam printer, LED printer or the like), a facsimile apparatus and a word processor. The process cartridge is prepared by integrally assembling the image bearing member and at least the developing means as the process means actable on the image bearing member into a cartridge detachably mountable to the main assembly of the image forming apparatus. The developing unit is a device (developing device) prepared by integrally assembling the developing means used for developing the electrostatic latent image on the image bearing member into a unit. The developing unit includes at least the developer carrying member and the regulating member. This developing unit is mounted in the main assembly of the image forming apparatus in a state in which the developing unit constitutes a part of the process cartridge or alone. The developing unit may also be constituted as the developing cartridge detachably mountable to the main assembly of the image forming apparatus alone. The main assembly of the image forming apparatus is a portion of the image forming apparatus from which the process cartridge or the developing cartridge is removed.

During the image formation, depending on an image forming operation start signal, the photosensitive drum 1 is rotationally driven and the surface thereof is electrically charged uniformly by the charging roller 2. The uniformly charged surface of the photosensitive drum 1 is subjected to scanning exposure to laser light which is outputted from the scanner unit 3 depending on image information. As a result, on the surface of the photosensitive drum 1, the electrostatic latent image (electrostatic image) depending on the image information is formed.

The electrostatic latent image formed on the photosensitive drum 1 is developed into the toner image by the developing device 4. In this embodiment, the toner image is formed by image portion exposure and reverse development. Specifically, the developing unit 4, the toner charged to the same polarity (negative in this embodiment) as a charge polarity of the photosensitive drum 1 is deposited on a portion (image portion, exposed portion) where electric charges are attenuated after the surface of the photosensitive drum 1 is uniformly charged. The toner image formed on the photosensitive drum 1 is transferred (primary-transferred) at the primary transfer portion N1 onto the intermediary transfer belt 5 by the action of the primary transfer roller 8.

At this time, to the primary transfer roller 8, from an unshown primary transfer bias voltage source (high-voltage source), a voltage of an opposite polarity to a normal charge polarity of the toner during development is applied. For example, during full-color image formation, the above-described process is successively performed at the image forming portions SY, SM, SC and SK, and then the toner images of the respective colors are successively superposed onto the intermediary transfer belt 5.

On the other hand, in synchronism with the toner image formation on the intermediary transfer belt 5, the recording material 12 is fed to the secondary transfer portion N2. By the action of the secondary transfer roller 9, at the secondary transfer portion N2, the toner images are transferred (secondary-transferred) collectively from the intermediary transfer belt 5 onto the recording material 12. At this time, the secondary transfer roller 9, from an unshown secondary transfer bias voltage source (high-voltage source), a voltage of an opposite polarity to the normal charge polarity of the toner is applied.

The recording material 12 on which the toner images are transferred is fed to a fixing device 10. The fixing device 10 applies heat and pressure to the recording material 12 at a fixing nip formed at a contact portion between the fixing roller and the pressing roller, so that the toner image is fixed on the recording material 12. Thereafter, the recording material 12 is discharged (outputted) to an outside of the main assembly 100*a* of the image forming apparatus 100.

A primary transfer residual toner remaining on the photosensitive drum 1 without being primary-transferred onto the intermediary transfer belt 5 at the primary transfer portion N1 is removed from the surface of the photosensitive drum 1 by the cleaning member 6 and then is collected in a residual toner accommodating container described later. On the other hand, a secondary transfer residual toner remaining on the intermediary transfer belt 5 without being secondary-transferred onto the recording material 12 at the secondary transfer portion N2 is removed from the surface of the intermediary transfer belt 5 by an intermediary transfer belt cleaning device 11 and then is collected in the intermediary transfer belt cleaning device 11.

The image forming apparatus 100 can also form a monochromatic (single-color) image or a multi-color image by using only a single image forming portion or only several (but not all of) desired image forming portions.

In this embodiment, the non-magnetic one-component toner is used as the developer, but the developer is not limited thereto. For example, as the developer, a magnetic one-component developer (magnetic toner) may also be used.

2. Structure of Process Cartridge

Next, a structure and an operation of the process cartridge 7 to be mounted in the image forming apparatus 100 in this embodiment will be described.

With respect to structures and operations of the developing unit and the process cartridge, terms, such as upper, lower, vertical and horizontal, which represent directions refer to directions of these as seen in a normal operation state unless otherwise specified. The normal operation state of the developing unit or the process cartridge is such a state that the developing unit or the process cartridge is properly mounted in the apparatus main assembly 100*a* properly disposed and is capable of being subjected to the image forming operation.

Figure 2:
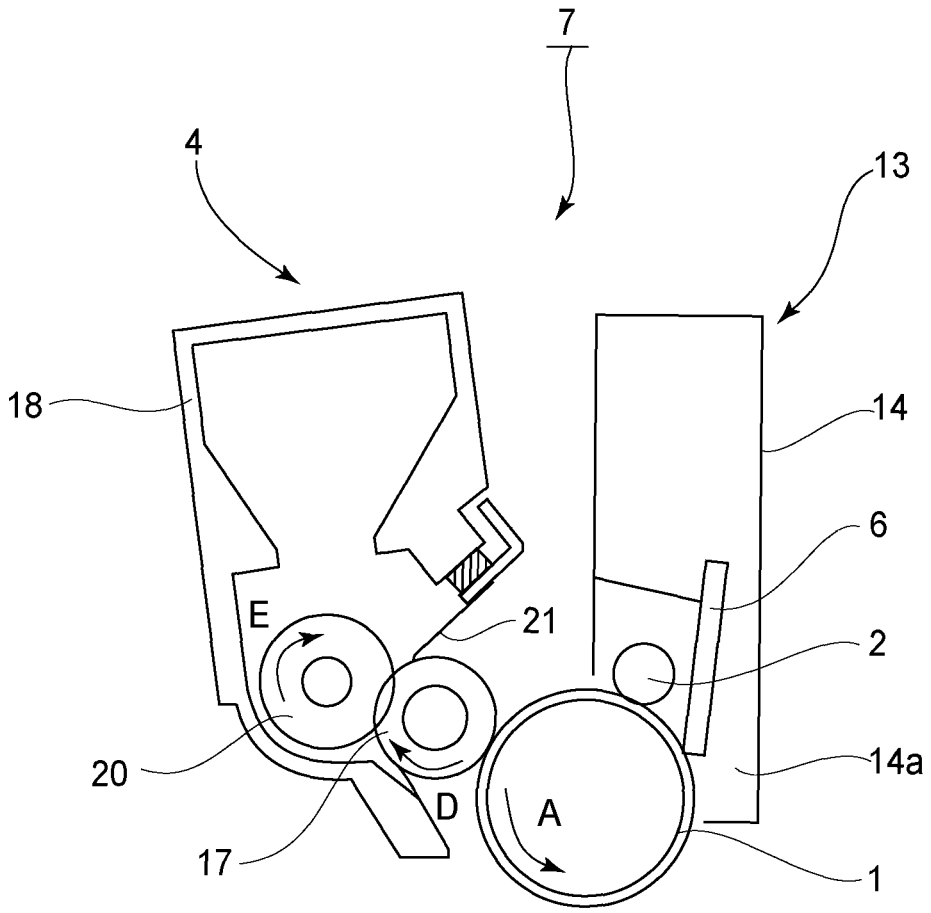
FIG. 2 is a schematic sectional view of a process cartridge in Embodiment 1 of the present invention.

FIG. 2 is a schematic sectional view of the process cartridge 7 in this embodiment. FIG. 2 shows a cross-section perpendicular to a rotational axis direction of the photosensitive drum 1. In this embodiment, the structures and the operations of the process cartridges 7 for the respective colors are substantially the same except for species (colors) of the toners accommodated.

The process cartridge 7 has a structure in which a photosensitive member unit 13 including the photosensitive drum 1 and the like and the developing unit 4 including a developing roller 17 and the like are integrally assembled. The photosensitive member unit 13 and the developing unit 4 use separate frames.

The photosensitive member unit 13 includes a cleaning frame 14 as a frame for supporting various elements (components) in the photosensitive member unit 13. To the cleaning frame 14, the photosensitive drum 1 is rotatably secured via an unshown bearing. The photosensitive drum 1 includes an aluminum drum support and a photosensitive layer obtained by successively coating the support with an under coat layer, a carrier generating layer and a carrier transporting layer which are functional films. The photosensitive drum 1 is rotationally driven in an indicated arrow A direction (counterclockwise direction) at a predetermined peripheral speed by a driving source (not shown). In this embodiment, the photosensitive drum 1 is a negatively chargeable organic photosensitive drum of 24 mm in diameter, and is rotationally driven at the peripheral speed of 100 mm/sec.

In the cleaning frame 14, the charging roller 2 and the cleaning member 6 are provided in contact with the outer peripheral surface of the photosensitive drum 1. The charging roller 2 contacts the surface of the photosensitive drum 1 with a predetermined press-contact force, and is rotated by rotation of the photosensitive drum 1 through friction with the surface of the photosensitive drum 1. Then, to a rotation shaft of the charging roller 2, a predetermined voltage is applied from an unshown charging bias voltage source (high-voltage source). In this embodiment, to the rotation shaft of the charging roller 2, a DC voltage of −1000 V is applied. At this time, when a surface potential of the photosensitive drum 1 is measured by a surface electrometer ("Model 344", manufactured by Trec Japan K.K.), the surface potential was about −450 V. The cleaning member 6 contacts the surface of the photosensitive drum 1 with a predetermined press-contact force. The primary transfer residual toner scraped off and removed from the surface of the rotating photosensitive drum 1 by the cleaning member 6 is collected in the residual toner accommodating portion 14*a*.

On the other hand, the developing unit 4 includes a developing (device) frame (developing container) 18 which is a frame for supporting various components (elements) in the developing unit 4. In the developing frame 18, the non-magnetic one-component developer (toner) is accommodated. The developing unit 4 is provided with a developing roller 17 as a developer carrying member for carrying the developer. In the developing unit 4, a toner supplying roller 20 as a developer supplying member for supplying the developer to the developing roller 17. Further, the developing unit 4 is provided with a developing blade 21 as a regulating member for regulating a layer thickness of the developer carried on the outer peripheral surface of the developing roller 17.

As the toner, toner particles of 5 μm to 8 μm in volume-average particle size are preferred. Here, the volume-average particle size was measured by a precise particle size distribution measuring device ("Multisizer 3", manufactured by Beckman Coulter K. K.). In this embodiment, a negatively chargeable non-magnetic toner which was manufactured by a suspension polymerization method and which was about 6.5 μm in volume-average particle size was used. In this embodiment, the toner manufactured by the suspension polymerization method was used, but the toner is not limited thereto. For example, the toner may also be a toner manufactured by a pulverization method or another polymerization method such as an emulsion polymerization method. In order to modify a surface property of the toner, it is possible to use the toner by depositing an inorganic substance on the toner. As the inorganic substance, it is possible to use silica, alumina, silicon oxide, titanium oxide, aluminum oxide, barium titanate, magnesium titanate, calcium titanate, strontium titanate, zinc oxide, tin oxide, silica sand, clay, mica, wollastonite, silious earth, chromium oxide, cerium oxide, iron red, antimony trioxide, magnesium oxide, zirconium oxide, barium sulfate, barium carbonate, calcium carbonate, silicon carbide, silicon nitride or the like. Of these substances, it is preferable that one species is used singly or two or more species are used in combination. The inorganic substance may be formed in a surface layer at the surface of the toner or may also be formed by depositing inorganic fine particles on the toner. In this embodiment, silicon oxide particles of 20 μm in volume-average particle size in an amount of about 1.5% of a weight of the toner and titanium oxide particles in an amount of about 0.1% of the weight of the toner were uniformly deposited on the surface of the toner.

The developing roller 17 carries the toner on its surface and feeds the toner to an opposing portion to the photosensitive drum 1, and develops the electrostatic latent image formed on the surface of the photosensitive drum 1. The developing roller 17 contacts the photosensitive drum 1 with a predetermined contact width and is rotationally driven in an indicated arrow D direction (clockwise direction) at a peripheral speed higher than the peripheral speed of the photosensitive drum 1. That is, in this embodiment, the developing roller 17 and the photosensitive drum 1 are rotated so that their movement directions are the same (from above toward below in this embodiment) at the opposing portion (contact portion). In this embodiment, the developing roller 17 is rotationally driven at the peripheral speed which is about 1.5 times the peripheral speed of the photosensitive drum 1. To the developing roller 17, a predetermined DC voltage is applied from an unshown developing bias voltage source (high-voltage source). In this embodiment, the DC voltage of −300 V is applied to a core metal of the developing roller 17. In this embodiment, the developing roller 17 effects development in contact with the photosensitive drum 1, but the present invention is not limited thereto. For example, a constitution in which the developing roller 17 effects development in a state in which the developing roller 17 is disposed closely to the photosensitive drum 1 with a predetermined gap may also be employed.

As the developing roller 17, it is possible to use a single-layer roller or a roller having a structure of a plurality of layers. As the single-layer roller, it is possible to use a roller prepared by forming, on a core metal, an elastic layer of a rubber material such as silicone rubber, urethane one rubber or hydrin rubber as an elastic material. As the roller having the structure of the plurality of layers, it is possible to use a roller prepared by forming, on the surface of the elastic layer, a surface layer formed by coating silicone resin, urethane resin, polyamide resin, fluorine-containing resin, or the like. In order to ensure stable elastic contact with the photosensitive drum 1, the elastic layer of the developing roller 17 may preferably have a hardness of 40° to 70° in terms of Asker-C hardness. In order to prevent image defect such as a lowering in developing efficiency, the developing roller 17 may preferably have a volume resistivity of $10^4$ Ω to $10^9$ Ω. In this embodiment, a developing roller 17 of 12 mm in diameter prepared in a manner that a 3 mm-thick elastic layer of silicon rubber was formed on the core metal of 6 mm in diameter, and on the surface of the elastic layer, an acrylic-urethane resin material was applied to form a surface layer was used. The thus-prepared developing roller 17 is 55° in Asker-C hardness and $10^6$ Ω in volume resistivity.

The volume resistivity of the developing roller 17 is measured in the following manner. A mirror-finished cylindrical metal member of 30 mm in diameter and the developing roller are in contact with each other over an entire longitudinal region of the developing roller under a contact load of 1.0 kgf in total (0.5 kgf in each of longitudinal sides). In this state, the metal member is rotated at a peripheral speed of 1.0 rps. Then, between the core metal of the developing roller and the metal member, the DC voltage of −50 V is applied, and an end-to-end voltage of a resistor of 1 kΩ connected with the ground is measured, so that from a measured voltage value, a current value and a resistance value of the developing roller is calculated.

The toner supplying roller 20 performs functions of not only supplying the toner from the inside of the developing unit 4 to the surface of the developing roller 17 at an opposing portion to the developing roller 17 and the neighborhood thereof but also scraping off the toner, from the surface of the developing roller 17, remaining on the surface of the developing roller 17 without being used for development. The toner supplying roller 20 is disposed in a contact state with the outer peripheral surface of the developing roller 17 with a predetermined contact width, and is rotationally driven in an indicated arrow E direction (clockwise direction) at a peripheral speed higher than the peripheral speed of the photosensitive drum 1. That is, in this embodiment, the toner supplying roller 20 and the developing roller 17 are rotated so that their movement directions are opposite to each other at the opposing portion (contact portion). In this embodiment, the toner supplying roller 20 is rotationally driven at the peripheral speed which is about 0.85 time the peripheral speed of the developing roller 17. To the toner supplying roller 20, a predetermined voltage is applied from an unshown supplying bias voltage source (high-voltage source). In this embodiment, a DC voltage of −300 V is applied to a core metal of the toner supplying roller 20. In this embodiment, the toner supplying roller 20 is rotationally driven at the peripheral speed lower than the peripheral speed of the developing roller 17, but the present invention is not limited thereto. For example, a constitution in which the toner supplying roller 20 is rotationally driven at a peripheral speed higher than the peripheral speed of the developing roller 17 may also be employed.

As the toner supplying roller 20, it is possible to use an elastic sponge roller prepared by forming a foamed member on an outer peripheral surface of an electroconductive core metal, or the like roller. As a material for the foamed member, it is possible to use, e.g., a material having a foamed skeleton-like sponge structure such as foamed urethane rubber, foamed EPDM rubber or foamed silicone rubber. In this embodiment, a toner supplying roller 20 of 13 mm in diameter prepared by forming, on a core metal of 5 mm in diameter, a 4 mm-thick polyurethane foam which has a foamed skeleton-like sponge structure and a relatively low hardness is used.

The developing blade 21 performs functions of not only regulating a layer thickness of the toner carried on the surface of the developing roller 17 but also imparting electric charges to the toner by triboelectric charging. The developing blade 21 is disposed in a contact state with the developing roller 17 in a side downstream of the contact portion between the toner supplying roller 20 and the developing roller 17 with respect to the movement direction of the developing roller 17. To the developing blade 21, a predetermined DC voltage is applied from an unshown regulating bias voltage source (high-voltage source). In this embodiment, the DC voltage of −500 V is applied to the developing blade 21. That is, to the developing blade 21, a voltage higher than the voltage applied to the developing roller 17 in a normal charge polarity side of the toner. However, the present invention is not limited thereto, but the voltage applied to the developing blade 21 is appropriately adjustable depending on a material for the developing blade 21, a toner characteristic or the like. The developing blade 21 will be described hereinafter in detail.

In the image forming operation, the toner in the developing unit 4 is carried and fed by the toner supplying roller 20, and is supplied to the developing roller 17 by the action of the toner supplying roller 20 at the contact portion between the toner supplying roller 20 and the developing roller 17. The toner supplied to the developing roller 17 is carried and fed by the developing roller 17, and then not only a layer thickness thereof is regulated by the developing blade 21 but also the toner is triboelectrically charged by the developing blade 21. The toner formed in thin layer on the developing roller 17 is carried and fed by the developing roller 17. Then, the toner develops the electrostatic latent image formed on the photosensitive drum 1 at the contact portion between the developing roller 17 and the photosensitive drum 1, so that the toner image is formed. The toner which is not subjected to development on the developing roller 17 is scraped off from the developing roller 17 by the action of the toner supplying roller 20. The toner scraped off from the developing roller 17 is returned to the inside of the developing frame 18, but a part of the toner is carried and fed by the toner supplying roller 20, and then is supplied, together with a toner newly supplied to the toner supplying roller 20, to the developing roller 17 again.

3. Structure of Regulating Member

A structure and action of the developing blade 21 as the regulating member in this embodiment will be described more specifically.

Figure 3:
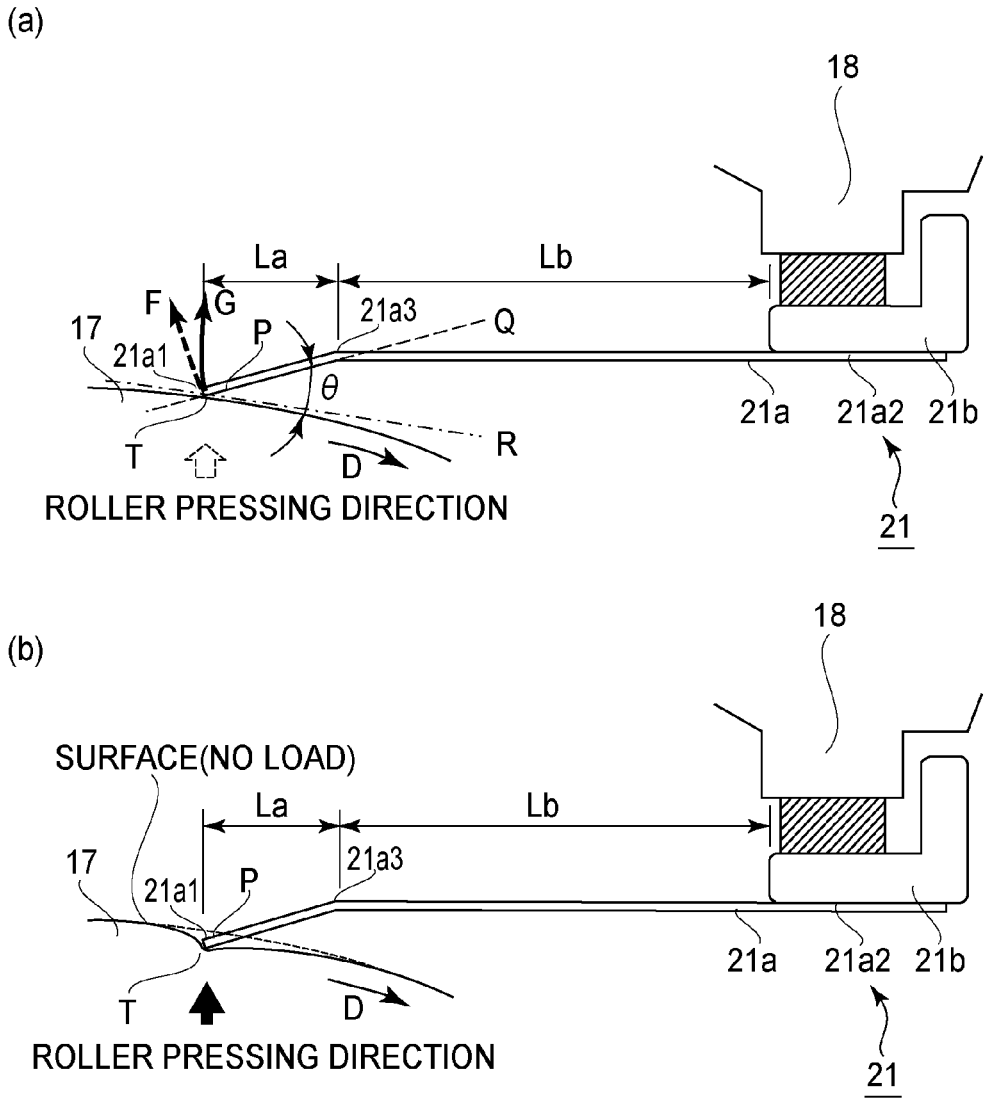
In FIG. 3, (a) is a schematic sectional view showing a state in which a developing blade and a developing roller in Embodiment 1 are in contact with each other under no load, and (b) is a schematic sectional view showing a state in which the developing blade and the developing roller in Embodiment 1 are in contact with each other with a predetermined press-contact force.

In FIG. 3, (a) is a schematic sectional view showing a state in which the developing blade 21 and the developing roller 17 in this embodiment are in contact with each other under no load, and (b) is a schematic sectional view showing a state in which the developing blade 21 and the developing roller 17 in this embodiment are in contact with each other with a predetermined press-contact force. In FIG. 3, each of (a) and (b) shows a cross-section perpendicular to a rotational axis direction of the developing roller 17.

The developing blade 21 includes a plate-like elastic member 21*a* and a supporting member 21*b* for supporting the elastic member 21*a*. The elastic member 21*a* is cantilevered and supported at a supporting portion 21*a*2 by the supporting member 21*b* fixed to the developing frame 18. The elastic member 21*a* contacts the developing roller 17 at a free end portion thereof in a free end side opposite from the supporting portion 21*a*2 supported by the developing frame 18. In this embodiment, from the state in which the elastic member 21*a* and the developing roller 17 are in contact with each other under no load as shown in (a) of FIG. 3, the elastic member 21*a* is press-contacted to the developing roller 17 by pressing the core metal of the developing roller 17 against the elastic member 21*a* in a certain amount as shown in (b) of FIG. 3. At this time, by an elastic restoring force generating by deformation of the elastic member 21*a* through the press-contact with the developing roller 17, a predetermined press-contact force is obtained. The developing blade 21 is provided at a contact position T between itself and the developing roller 17 so that the free end portion of the elastic member 21*a* in the free end side contacts the developing roller 17 in a state (counter direction) in which the free end portion is directed toward an upstream direction with respect to the movement direction of the developing roller 17. That is, the elastic member 21*a* contacts the developing roller 17 so that the free end portion thereof in the free end side is positioned upstream of the supporting portion 21*a*2 supported by the developing frame 18 with respect to the movement direction of the developing roller 17. As a result, an amount in which the toner carried and fed by the developing roller 17 is taken in the contact position between the elastic member 21*a* and the developing roller 17 can be reduced, so that a degree of a lowering in press-contact force by powder pressure of the toner can be decreased.

As the elastic member 21*a*, it is possible to use a plate-like member formed of a material having elasticity (spring property), such as a thin metal plate of stainless steel, phosphor bronze, aluminum alloy or the like or a thin plate of a high-hardness electroconductive resin material. As the supporting member 21*b*, it is possible to use a plate-like member such as a metal plate thicker than the elastic member 21*a*. In this embodiment, the developing blade 21 constituted by fixing the elastic member 21*a* consisting of a 0.08 mm-thick thin plate of stainless steel on the supporting member 21*b* obtained by bending a 1.2 mm-thick iron plate in an L-shape in cross-section is used. In this embodiment, a pressing amount (from the contact state under no load) of the developing roller 17 against the elastic member 21*a* formed of the thin plate of stainless steel was 1.2 mm.

The elastic member 21*a* is provided so as to contact the developing roller 17 with a predetermined angle. Specifically, as shown in (a) of FIG. 3, the elastic member 21*a* is provided so that an angle θ when the elastic member 21*a* contacts the developing roller 17 in a no-load state is 10° to 45° (10° or more and 45° or less). The angle θ is an angle formed between a plane Q passing through a contact portion 21*a*1 with the developing roller 17 and a surface P of the elastic member 21*a* continuous to and downstream of the contact portion 21*a*1 with respect to the movement direction of the developing roller 17 and a tangential plane R of the developing roller 17 under no load at a contact position T between the elastic member 21*a* and the developing roller 17. The plane Q passing through the surface P is also referred to as a reference plane (surface).

As a result, only a portion of the elastic member 21*a* in the neighborhood of a free edge portion of the elastic member 21*a* contacts the developing roller 17, so that a contact region between the elastic member 21*a* and the developing roller 17 can be narrowed. For that reason, a change in shape of the elastic member 21*a* due to abrasion of the contact portion 21*a*1 with the developing roller 17 can be decreased.

When the angle θ is smaller than 10°, in the case where the developing blade 21 and the developing roller 17 are in contact with each other with the predetermined press-contact force, due to elastic deformation of the elastic member 21*a*, the contact region between the elastic member 21*a* and the developing roller 17 are liable to extend. For that reason, the change in shape of the elastic member 21*a* due to abrasion of the contact portion 21*a*1 with the developing roller 17 becomes large, so that not only the contact region between the elastic member 21*a* and the developing roller 17 further extends but also the press-contact force acting on regulation of the toner layer thickness lowers. On the other hand, when the angle θ is larger than 45°, the free end portion of the elastic member 21*a* is liable to be turned up by the rotation of the developing roller 17, so that it becomes difficult to stably regulate the toner layer thickness. Particularly, in the case where a thin metal plate manufactured by blanking with a metal die (press work) is used as the elastic member 21*a*, burrs at a fracture surface are liable to influence the regulation of the toner layer thickness, so that a vertical stripe or the like generates in the thin toner layer after the regulation. In this embodiment, the elastic member 21*a* was provided so that the angle θ was 15°.

The elastic member 21*a* includes a first region La including the contact portion 21*a*1 with the developing roller 17 and a second region Lb which is provided continuously from the first region La toward the supporting portion 21*a*2 supported by the developing frame 18 and which is lower in rigidity than the first region La. The second region Lb is provided downstream of the plane (reference plane) Q passing through the surface P with respect to the movement direction of the developing roller 17.

The second region Lb is lower in rigidity than the first region La, and therefore an elastic deformation direction of the elastic member 21*a* when the elastic member 21*a* is press-contacted to the developing roller 17 is close to an elastic deformation direction of the second region Lb. Therefore, by providing the second region Lb in a side downstream of the plane (reference plane) Q passing through the surface P with respect to the movement direction of the developing roller 17, the elastic deformation direction of the elastic member 21*a* is changed from an indicated arrow F direction to an indicated arrow G direction. Here, the arrow G direction is closer to a normal to the tangential plane R of the developing roller 17 under no load at the contact position T between the elastic member 21*a* and the developing roller 17 than the arrow F direction is. As a result, a degree of extension of the contact region due to the elastic deformation of the elastic member 21*a* becomes small. On the other hand, the first region La including the contact portion 21*a*1 with the developing roller 17 is higher in rigidity than the second region, e.g., by bending, and therefore a degree of the elastic deformation when the elastic member 2*a* is press-contacted to the developing roller 17 relatively becomes small. Therefore, the degree of extension of the contact region due to the elastic deformation in the neighborhood of the contact portion 21*a*1 of the elastic member 21*a* with the developing roller 17 becomes small.

As described above, in the present invention, the elastic member 21*a* is provided so that the angle θ when the elastic member 21*a* contacts the developing roller 17 in the no-load state is 10° to 45° (10° or more and 45° or less). The elastic member 21*a* includes a first region La including the contact portion 21*a*1 with the developing roller 17 and a second region Lb which is provided continuously from the first region La toward the supporting portion 21*a*2 supported by the developing frame 18 and which is lower in rigidity than the first region La. The second region Lb is provided downstream of the plane (reference plane) Q passing through the surface P with respect to the movement direction of the developing roller 17. As a result, the degree of extension of the contact region due to the elastic deformation of the elastic member 21*a* becomes small, so that as shown in (b) of FIG. 3, the press-contact force can be made large in a state in which only a portion of the elastic member 21*a* in the neighborhood of the free edge portion contacts the developing roller 17, i.e., in a state in which the contact region is small (narrow). As a result, the change in shape of the elastic member 21*a* due to the elastic deformation of the contact portion 21*a*1 with the developing roller 17 can be made small. Therefore, even in the case where the developing unit 4 is used for a long term, the degree of the extension of the contact region between the elastic member 21*a* and the developing roller 17 and the degree of the lowering in press-contact force acting on the regulation of the toner layer thickness can be made small.

In this embodiment, the elastic member 21*a* was formed with a flat thin plate-like stainless steel plate having a length from the supporting portion 21*a*2 (base end portion) to the contact portion 21*a*1 (free end portion) with the developing roller 17 during application of no load, i.e., a so-called free length, of 10 mm. Further, in this embodiment, the thin stainless steel plate was bent toward the developing roller 17 by 10° at a position of 3.0 mm from the free end in the free end side. At this time, a region from the free end of the elastic member 21*a* to a bent portion 21*a*3 is the first region La, and a region from the bent portion 21*a*3 to the supporting portion 21*a*2 supported by the supporting member 21*b* is the second region Lb. That is, in this embodiment, the elastic member 21*a* is formed with the plate-like member bent in at least one position between the supporting portion 21*a*2 and the free end portion with respect to a free length direction. With respect to the free length direction, a region of the elastic member 21*a* from the supporting portion 21*a*2 to the closest bent portion to the supporting portion 21*a*2 is the second region Lb. Further, with respect to the free length direction, a region of the elastic member 21*a* from the closest bent portion to the free end of the elastic member 21*a* is the first region La. At this time, with respect to the free length direction, a length of the second region Lb is longer than a length of the first region La. Particularly, in this embodiment, the elastic member 21*a* is bent in one position between the supporting portion 21*a*2 and the free end portion with respect to the free length direction, and the bent portion 21*a*3 is bent outwardly in a side opposite from the developing roller 17.

The shape and dimension of the elastic member 21*a* are not limited to those in this embodiment. For example, the position and the bending angle of the bent portion 21*a*3 may also be changed.

The contact portion 21*a*1 of the elastic member 21*a* with the developing roller 17 may preferably have a small radius of curvature. This is because when the radius of curvature becomes large, an amount in which the toner carried and fed by the developing roller 17 is taken in the contact position between the elastic member 21*a* and the developing roller 17 becomes large and thus the degree of the lowering in press-contact force due to power pressure of the toner becomes large. In this embodiment, a shear droop portion (outwardly curved surface toward the developing roller 17) of the tin stainless steel plate manufactured by the press work is used as the contact portion 21*a*1 of the elastic member 21*a* with the developing roller 17. However, the present invention is not limited thereto, but for example, a region finished to have an appropriate radius of curvature by abrasion or the like may also be used as the contact portion 21*a*1 of the elastic member 21*a* with the developing roller 17.

Figure 14:
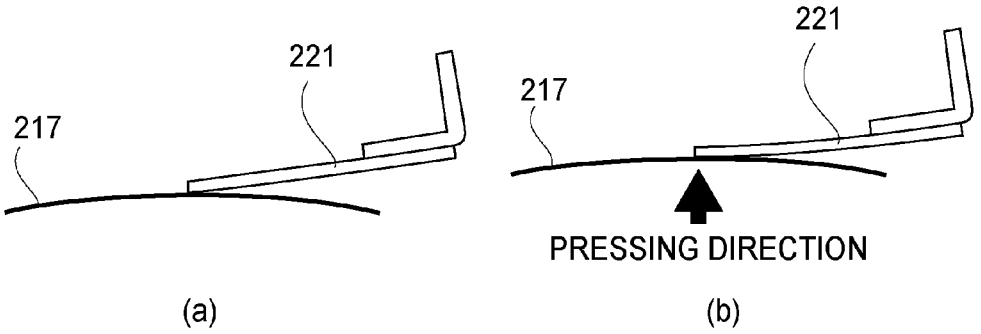
In FIG. 14, (a) and (b) are schematic sectional views each showing a contact state of a conventional regulating member.

In a conventional regulating member, as shown in (a) of FIG. 14, a regulating member 221 was placed in a state in which only a free edge portion thereof was contacted to a developer carrying member 217 in some cases. In this state, a pressing amount of the developer carrying member 217 against the regulating member 221 is small, and therefore a press-contact force of the regulating member 221 against the developer carrying member 217 is relatively small. Therefore, in the case where the developing device is used for a long term, the contact region between the regulating member 221 and the developer carrying member 217 is narrow and therefore a degree of a change in contact state due to abrasion is small. However, the press-contact force was small, and therefore the influence of a change in toner characteristic or the like was not able to be suppressed, so that it was difficult to stably regulate the toner layer thickness.

Therefore, as shown in (b) of FIG. 14, the regulating member 221 was placed in a state in which the press-contact force was made sufficiently large to bring the regulating member 221 into press-contact with the developer carrying member 217 in some cases. In order to increase the press-contact force, when the pressing amount of the developer carrying member 217 against the regulating member 221 is increased, the regulating member 221 is elastically deformed, so that the contact region between the regulating member 221 and the developer carrying member 217 extends. That is, a broad region of the regulating member including the free edge portion is in a contact state with the developer carrying member 217. Then, in the case where the developing device was used for a long term, the influence of the abrasion of the contact portion of the regulating member 221 with the developer carrying member 217 became large, so that there arose a problem that the press-contact force acting on regulation of the toner layer thickness was liable to lower.

However, according to this embodiment, even in the case where the developing blade 21 and the developing roller 17 are in contact with each other with a high press-contact force, it is possible to reduce a degree of the extension of the contact region between the developing blade 21 and the developing roller 17 due to the elastic deformation of the elastic member 21*a*. For that reason, even in the case where the developing unit 4 is used for a long term, a change in shape of the contact portion 21*a*1 between the developing blade 21 and the developing roller 17 due to the abrasion, i.e., a change in contact state, can be made small. Therefore, a degree of the lowering in press-contact force acting on the regulation of the toner layer thickness is small, so that it becomes possible to effect stable regulation of the toner layer thickness. By changing the shape of the elastic member 21*a* in this manner, it is possible to increase a degree of freedom of arrangement of the developing blade 21.

<Embodiment 2>

Basic constitution and operation of an image forming apparatus in this embodiment are the same as those in Embodiment 1. Accordingly, in this embodiment, elements having the same or corresponding functions or constitutions as those in Embodiment 1 are represented by the same reference numerals or symbols and will be omitted from detailed description.

In this embodiment, the pressing amount (from a contact state under no load) of the developing roller 17 against the elastic member 21*a* was 1.6 mm. That is, a constitution in which the press-contact force of the elastic member 21*a* against the developing roller 17 was larger than the press-contact force in Embodiment 1 was employed.

<Embodiment 3>

Basic constitution and operation of an image forming apparatus in this embodiment are the same as those in Embodiment 2. Accordingly, in this embodiment, elements having the same or corresponding functions or constitutions as those in Embodiment 2 are represented by the same reference numerals or symbols and will be omitted from detailed description.

In this embodiment, the thin stainless steel plate as the elastic member 21*a* was bent by 5° toward the developing roller 17 in the free end side in a position of 3.0 mm from the free end. At this time, the angle θ when the elastic member 21*a* contacts the developing roller 17 in a no-load state is 10°. That is, a constitution in which the contact region between the elastic member 21*a* and the developing roller 17 was somewhat broader than the contact region in Embodiment 2 was employed.

COMPARISON EXAMPLE 1

A constitution in this comparison example is substantially the same as those in Embodiment 1 except for the following points. In this comparison example, elements having corresponding functions or constitutions to those in Embodiment 1 are represented by the same reference numerals or symbols.

Figure 4:
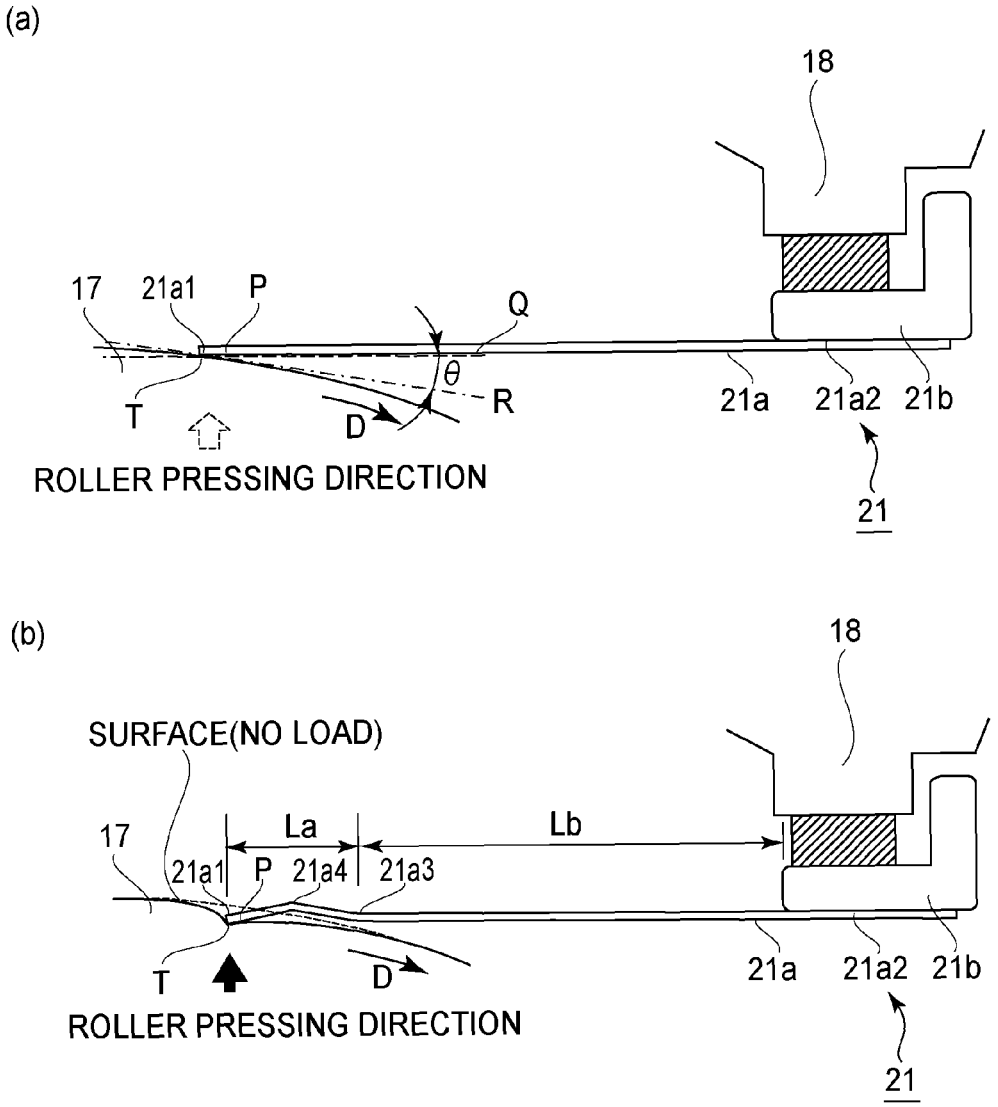
In FIG. 4, (a) is a schematic sectional view showing a state in which a developing blade and a developing roller in Comparison Example 1 are in contact with each other under no load, and (b) is a schematic sectional view showing a state in which the developing blade and the developing roller in Comparison Example 1 are in contact with each other with a predetermined press-contact force.

In FIG. 4, (a) is a schematic sectional view showing a state in which the developing blade 21 and the developing roller 17 in this comparison example are in contact with each other under no load, and (b) is a schematic sectional view showing a state in which the developing blade 21 and the developing roller 17 in this comparison example are in contact with each other with a predetermined press-contact force. In FIG. 4, each of (a) and (b) shows a cross-section perpendicular to a rotational axis direction of the developing roller 17.

In this comparison example, a flat thin plate-like stainless steel plate of 10 mm in free length is used as the elastic member 21*a*. In this comparison example, the angle θ was 5°. As shown in (a) of FIG. 4, a region from a supporting portion 21*a*2 of the elastic member 21*a* to a contact portion 21*a*1 with the developing roller 17 is positioned on an extension line of a plane (reference plane) Q passing through the surface S. For that reason, as shown in (b) of FIG. 4, in the case where the developing blade 21 and the developing roller 17 are in contact with each other with a predetermined press-contact force, a degree of extension of the contact region between the elastic member 21*a* and the developing roller 17 due to the elastic deformation of the elastic member 21*a* is large. That is, compared with Embodiment 1, the contact region between the elastic member 21*a* and the developing roller 17 becomes broad.

COMPARISON EXAMPLE 2

A constitution in this comparison example is substantially the same as those in Comparison Example 1 except for the following points. In this comparison example, elements having corresponding functions or constitutions to those in Comparison Example 1 are represented by the same reference numerals or symbols.

In this comparison example, the pressing amount (from a contact state under no load) of the developing roller 17 against the elastic member 21*a* was 1.6 mm. That is, a constitution in which the press-contact force of the elastic member 21*a* against the developing roller 17 was larger than the press-contact force in Comparison Example 1 was employed.

4. Comparison 1 Between Embodiments and Comparison Examples

An effect of Embodiments will be further described in comparison with Comparison Examples. In the constitutions in Embodiments and Comparison Examples, a fluctuation in toner amount on the developing roller 17 after layer thickness regulation when the developing unit 4 was used for a long term was evaluated.

In this embodiment, first, the developing unit 4 is filled with the toner. After a solid white image is continuously printed on 20 A4-sized sheets, a toner amount M0 on the developing roller 17 after being subjected to layer thickness regulation by the developing blade 21 is measured. Then, with respect to a A4-sized recording material, a lateral line image of 1% in image ratio is intermittently printed on 13000 sheets. Here, intermittent printing means a printing method in which an operation of the developing unit 4 is once stopped after printing of a predetermined print number and then is performed again. In other words, immediately after start of the printing operation and immediately before end of the printing operation, there arises a time when the developing unit 4 is driven in a non-printing state. In this evaluation, setting was made so that the operation of the developing unit 4 was once stopped after continuous printing of two sheets and then the printing operation was performed again. Thereafter, a toner amount M1 on the developing roller 17 after the layer thickness is regulated by the developing blade 21 is measured. Here, the toner amount on the developing roller was obtained by collecting the toner (particles) on the developing roller 17 by suction using a suction Faraday gauge containing a filter and then by dividing an increase in weight of the filter at that time by a toner collecting area. That is, each of M0 and M1 shows a toner amount per unit area (mg/cm$^2$) on the developing roller 17.

An amount of change (mg/cm$^2$) in toner amount was calculated by the following formula and then was evaluated.

$$\text{Amount of change (mg/cm}^2\text{) in toner amount} = M1 - M0$$

That is, the amount of change in toner amount shows an amount in which the toner amount on the developing roller 17 after being subjected to the layer thickness regulation by the developing blade 21 is changed from the toner amount at the time of start of use.

This evaluation was made by printing of the same (single) color under an environment of 23° C. and 50% RH.

An evaluation result is shown in Table 1. An evaluation criterion is as follows.

○: Amount of change in toner amount of 0.10 mg/cm$^2$ or more

Δ: Amount of change in toner amount of larger than 0.10 mg/cm$^2$ and less than 0.14 mg/cm$^2$.

×: Amount of change in toner amount of 0.14 mg/cm$^2$ or more.

TABLE 1

| | BA*1 | DRPA*2 | ACTA*3 |
|---|---|---|---|
| EMB. 1 | 10° | 1.2 mm | Δ |
| EMB. 2 | 10° | 1.6 mm | ○ |
| EMB. 3 | 5° | 1.6 mm | ○ |
| COMP. EX. 1 | — | 1.2 mm | x |
| COMP. EX. 2 | — | 1.6 mm | x |

*1"BA" is the bending angle.
*2"DRPA" is the developing roller pressing amount
*3"ACTA" is the amount of change in toner amount.

As shown in Table 1, in Comparison Example 1 and Comparison Example 2, the amount of change in toner amount on the developing roller 17 after the layer thickness was regulated by the developing blade 21 was 0.14 mg/cm$^2$ or more. Further, in Comparison Example 2, although the press-contact force of the elastic member 21*a* against the developing roller 17 was larger than the press-contact force in Comparison Example 1, it was difficult to effect the toner thickness regulation shorter than Comparison Example 1. This may be attributable to the following reason. In Comparison Examples 1 and 2, in the case where the developing blade 21 and the developing roller 17 are in contact with each other with the predetermined press-contact force, a degree of extension of the contact region between the elastic member 21*a* and the developing roller 17 due to the elastic deformation of the elastic member 21*a* is large. That is, compared with Embodiments 1 to 3, in Comparison Examples 1 and 2, the contact region between the elastic member 21*a* and the developing roller 17 is large. In Comparison Example 2, the press-contact force of the elastic member 21*a* against the developing roller 17 is larger than the press-contact force in Comparison Example 1, and therefore the contact region between the elastic member 21*a* and the developing roller 17 becomes broader than the contact region in Comparison Example 1. For that reason, in Comparison Examples 1 and 2, in the case where the developing unit 4 is used for a long term, a degree of change in shape due to abrasion of the contact portion 21*a*1 of the elastic member 21*a* with the developing roller 17 becomes large. Therefore, not only the contact region between the developing blade 21 and the developing roller 17 further extends but also the press-contact force acting on the regulation of the toner layer thickness lowers. As a result, it becomes difficult to stably regulate the layer thickness of the toner carried on the developing roller 17.

On the other hand, in Embodiments 1 to 3, the amount of change in toner amount on the developing roller 17 after the layer thickness was regulated by the developing blade 21 was less than 0.14 mg/cm$^2$. Further, in Embodiment 2, the press-contact force of the elastic member 21*a* against the developing roller 17 was larger than the press-contact force in Embodiment 1, it was possible to effect the toner thickness regulation shorter than Embodiment 1. In Embodiment 3, the angle θ when the elastic member 21*a* contacts the developing roller 17 in the no-load state is smaller than the angle θ in Embodiment 2, so that the contact region between the elastic member 21*a* and the developing roller 17 somewhat extends, but it was possible to effect stable toner layer thickness regulation. This is because, according to the present invention, even in the case where the developing blade 21 and the developing roller 17 are in contact with each other with a high press-contact force, a degree of extension of the contact region between the developing blade 21 and the developing roller 17 due to the elastic deformation of the elastic member 21*a* can be made small. Therefore even in the case where the developing unit 4 is used for a long term, a degree of change in shape due to abrasion of the contact portion 21*a*1 of the elastic member 21*a* with the developing roller 17, i.e., a degree of change in contact state can be made small. As a result, a degree of the lowering in press-contact force acting on the regulation of the toner layer thickness is small, so that stable toner layer thickness regulation becomes possible.

As described above, according to the present invention, the toner carried on the developing roller 17 can be stably regulated for a long term.

<Embodiment 4>

Figure 5:
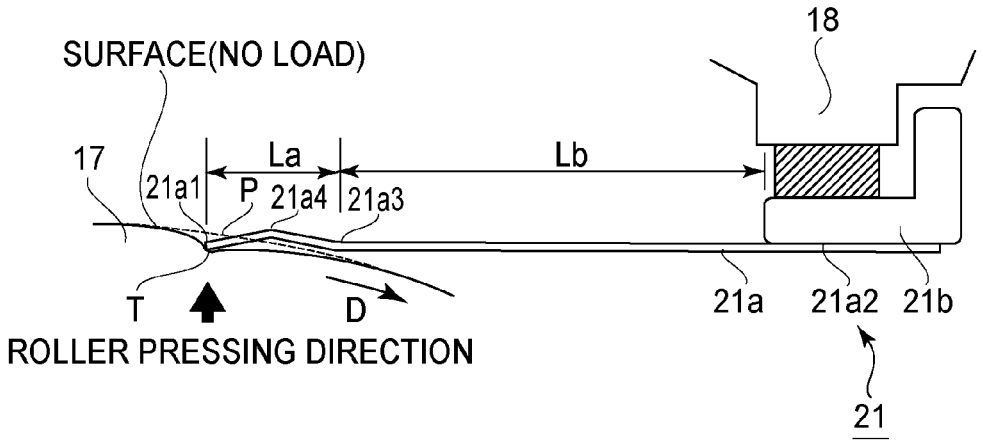
FIG. 5 is a schematic sectional view of a developing blade in Embodiment 4.
Figure 6:
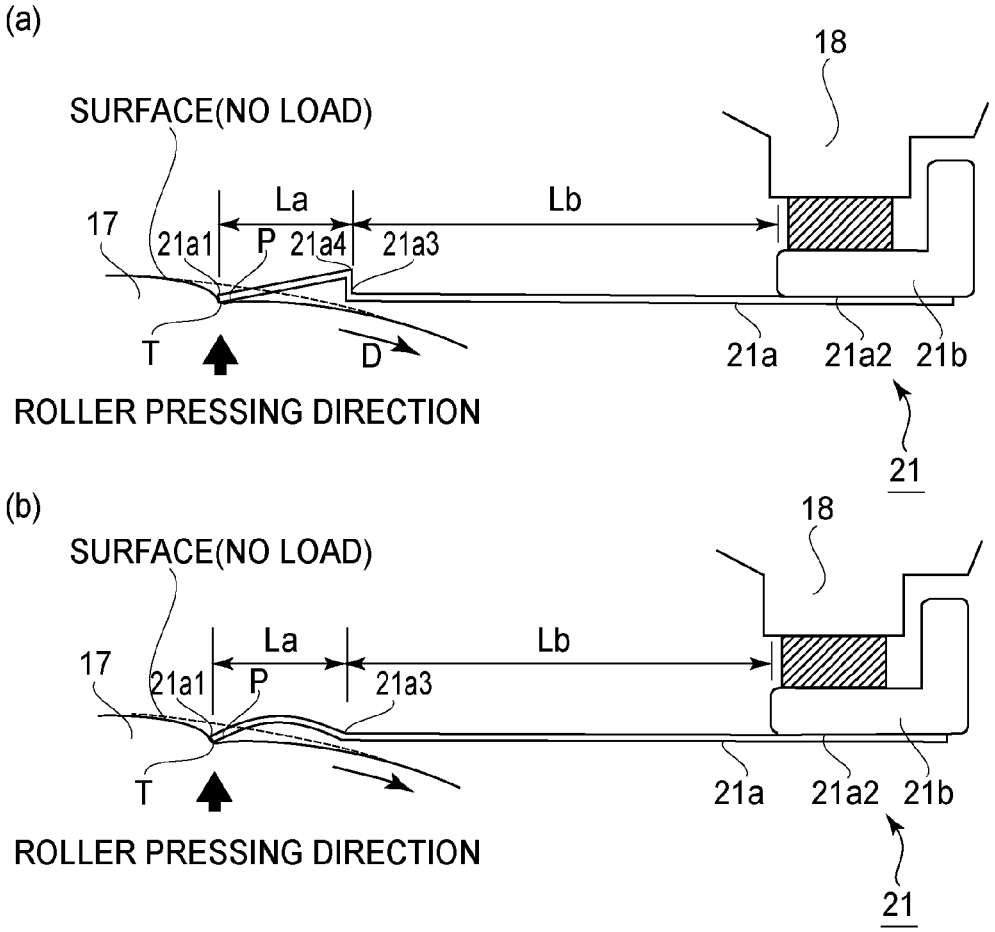
In FIG. 6, (a) is schematic sectional view of a developing blade in a modified example of Embodiment 4, and (b) is a schematic sectional view of a developing blade in another modified example of Embodiment 4.

Basic constitution and operation of an image forming apparatus in this embodiment are the same as those in Embodiment 1. Accordingly, in this embodiment, elements having the same or corresponding functions or constitutions as those in Embodiment 1 are represented by the same reference numerals or symbols and will be omitted from detailed description. FIG. 5 is a schematic sectional view of a developing blade 21 in this embodiment. In FIG. 6, (a) and (b) are schematic sectional views each showing a developing blade in a modified example of this embodiment. Each of FIGS. 5 and 6 shows a cross-section perpendicular to a rotational axis direction of the developing roller 17.

In this embodiment, the developing blade 21 includes a bent portion 21*a*4 in a first region La of an elastic member 21*a*, so that a projected shape is formed in side opposite from the developing roller 17. In this way, the elastic member 21*a* may also be bent in at least two positions between the supporting portion 21*a*2 and the free end portion with respect to the free length direction. In this case, with respect to the free length direction, the closest bent portion to the supporting portion 21*a*2 is bent outwardly toward the developing roller 17 (developer carrying member), and the closest bent portion to the free end portion is bent outwardly in a side opposite from the developing roller 17.

In this embodiment, a thin stainless steel plate as the elastic member 21*a* was bent in the free end side by the press work so that the plate was bent by 10° in a position of 3.0 mm from the free end in a side opposite from the developing roller 17 and by 20° in a position of 1.5 mm from the free end in a side toward the developing roller 17. In this way, also in this embodiment, the developing blade 21 was provided so that the angle θ when the elastic member 2*a* contacted the developing roller 17 in the no-load state was 15°.

However, the shape of the first region La is not limited thereto. For example, as shown in (a) of FIG. 6, the position and the bending angle of the bent portion 21*a*4 may be changed. Further, as shown in (b) of FIG. 6, the elastic member 21*a* may also be curved convexly in the first region in the side opposite from the developing roller 17.

Incidentally, the bent portion 21*a*3 is provided so as not to contact the developing roller 17. This is because when the bent portion 21*a*3 contacts the developing roller 17, the press-contact force exerted on the contact portion 21*a*1 of the elastic member 21*a* with the developing roller 17 lowers, and thus it becomes difficult to stably regulate the layer thickness of the toner carried on the developing roller 17.

As described above, according to this embodiment, the rigidity of the elastic member 21*a* in the first region La becomes high, so that the degree of the contact region in the neighborhood of the contact portion 21*a*1 of the elastic member 21*a* with the developing roller 17 due to the elastic deformation becomes further small. Therefore, it becomes possible to further stably regulate the toner layer thickness for a long term. When the bent portion or the curved portion is provided in the first region La, a plastic deformation region becomes broad, so that straightness of the contact portion 21*a*1 of the elastic member 21*a* with the developing roller 17 with respect to a longitudinal direction becomes high. Therefore, a variation in contact state becomes small, so that it becomes possible to uniformly regulate the toner layer thickness with respect to the longitudinal direction.

<Embodiment 5>

Basic constitution and operation of an image forming apparatus in this embodiment are the same as those in Embodiment 1. Accordingly, in this embodiment, elements having the same or corresponding functions or constitutions as those in Embodiment 1 are represented by the same reference numerals or symbols and will be omitted from detailed description.

In the case where the elastic member 21*a* is fixedly supported by the developing frame 18, there is a need to increase the press-contact force by increasing the pressing amount of the elastic member 21a against the developing roller 17. For that reason, the contact state largely changes depending on the pressing amount in some cases. Therefore, in this embodiment, a constitution in which the elastic member 21*a* is supported rotatably (swingably) relative to the developing frame 18 and in which the developing blade 21 is urged toward the developing roller 17 by rotating (swinging) the developing blade 21 using an urging means is employed.

Figure 7:
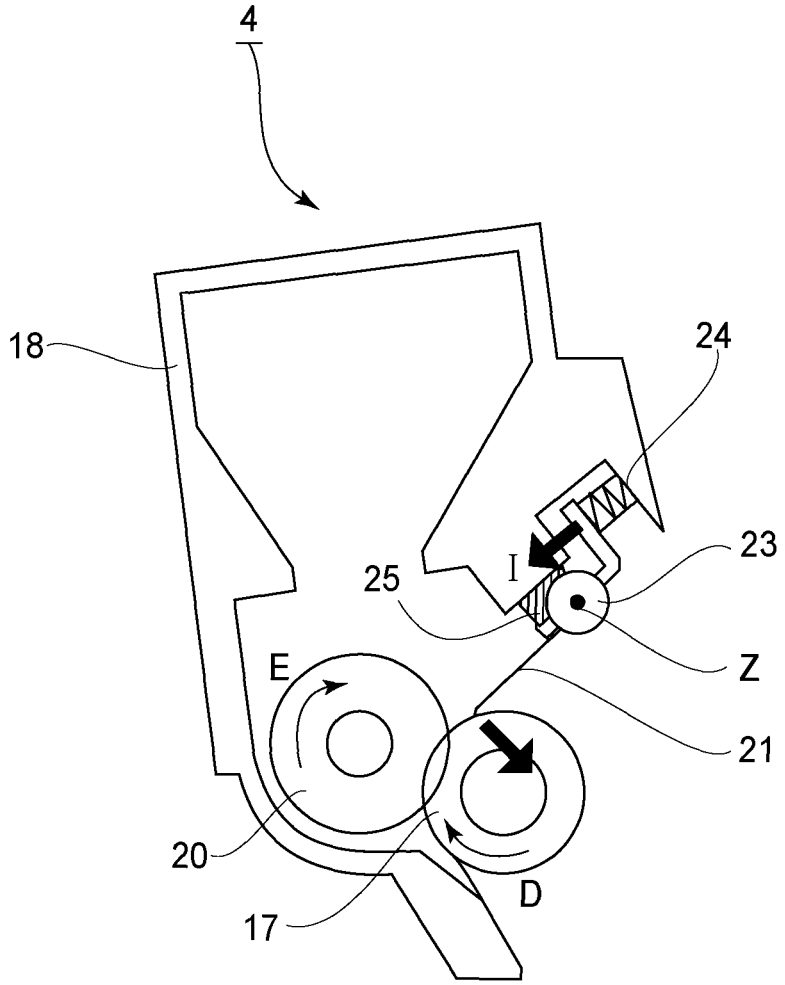
FIG. 7 is a schematic sectional view of a developing unit in Embodiment 5.
Figure 8:
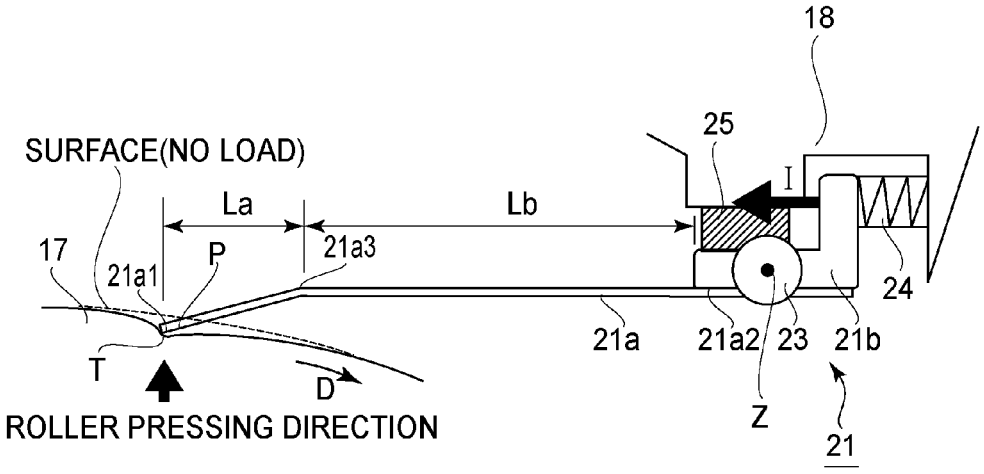
FIG. 8 is a schematic sectional view of a developing blade in Embodiment 5.

FIG. 7 is a schematic sectional view of a developing unit 4 in this embodiment, FIG. 8 is a schematic sectional view of the developing roller 21 in this embodiment. FIGS. 7 and 8 show cross sections perpendicular to a rotational axis direction of the developing roller 17.

A supporting member 21*b* includes a swing fulcrum shaft 23 at each of end portions with respect to the longitudinal direction (axial direction of the developing roller 17). The swing fulcrum shaft 23 is a shaft portion for causing the supporting member 21*b* to be rotatable and is rotatably supported by the developing frame 18. As a result, an entirety of the developing blade 21 including the elastic member 21*a* is rotatable (swingable) about an axis Z of the swing fulcrum shaft 23.

In this embodiment, the supporting member 21*b* is provided with the swing fulcrum shaft 23, but the present invention is not limited thereto. For example, a swingable frame including the swing fulcrum shaft 23 is provided separately, and is secured to the supporting member 21*b* at an arbitrary position.

Between the developing frame 18 and the supporting member 21*b*, a seal member 25 is provided over the longitudinal direction (axial direction of the developing roller 17). The seal member 25 is compressed in a certain amount of the developing frame 18 and the supporting member 21*b*. In this embodiment, as the seal member 25, a foamed member of an EPDM mixture is used.

Further, between the developing frame 18 and the supporting member 21*b*, a pressing spring 24 (urging means) for imparting moment to the developing blade 21 about the axis Z (rotation center) of the swing fulcrum shaft 23 by pressing (urging) the supporting member is provided. In this embodiment, as the pressing spring 24, a compression spring is used. By the pressing spring 24, of surfaces of the supporting member 21*b* bent in an L-shape in cross-section, the surface perpendicular to the surface where the elastic member 21*a* is fixedly supported is urged in an indicated arrow I direction. Thus, counterclockwise moment is applied to the developing blade 21 about the axis Z (rotation center) of the swing fulcrum shaft 23. As a result, the elastic member 21*a* is press-contacted to the developing roller 17. That is, the press-contact force of the elastic member 21*a* against the developing roller 17 is determined by a balance of moment of forces applied about the axis Z (rotation center) of the swing fulcrum shaft 23, so that when the urging force by the pressing spring 24 is made large, the press-contact force can be increased. For that reason, it becomes possible to increase the press-contact force while keeping the pressing amount of the developing roller 17 against the elastic member 21*a* at a certain value. That is, even when the press-contact force is increased, a degree of the change in contact state is small.

In this embodiment, as the pressing spring 24 is used, but the present invention is not limited thereto. For example, a tension coil spring, a leaf spring or the like may also be used. The pressing spring 24 may also be provided so as to directly urge (press) the elastic member 21*a*, but it is preferable that the pressing spring 24 is provided so as to urge the supporting member 21*b* having a high rigidity. This is because in the case where the pressing spring 24 directly urges the elastic member 21*a*, unexpected deformation such as distortion is liable to generate in the elastic member 21*a*. In this embodiment, the pressing spring 24 is provided so as to urge the supporting member 21*b*.

As described above, according to this embodiment, not only an effect similar to that in Embodiment 1, but also a degree of the influence (change in contact state when the press-contact force is increased) of the pressing amount of the developing roller 17 against the elastic member 21*a* can be reduced. Therefore, for a long term, further stable regulation of the toner layer thickness can be made.

<Embodiment 6>

Basic constitution and operation of an image forming apparatus in this embodiment are the same as those in Embodiment 1. Accordingly, in this embodiment, elements having the same or corresponding functions or constitutions as those in Embodiment 1 are represented by the same reference numerals or symbols and will be omitted from detailed description.

In Embodiment 1, the elastic member 21*a* formed with the thin stainless steel plate is used. The hardness of general-purpose stainless steel (SUS 304) as used in Embodiment 1 is lower than the hardness such as silicon oxide particles or the like deposited as an external additive on the toner surface. When a nanoindenter hardness of the thin stainless steel plate used as the elastic member 21*a* in this embodiment was measured, the hardness was about 9 GPa. As an alternative to the silicon oxide particles used as the external additive used in this embodiment, when fused silica glass was used for measurement of the nanoindenter hardness, the hardness was about 10 GPa.

For that reason, even in the constitution in Embodiment 1, by the sliding (friction) between the developing blade 21 and the developing roller 17 via the toner in the contact region, the contact portion 21*a*1 of the developing blade 21 with the developing roller 17 is abraded, so that the change in shape generates in a degree. The nanoindenter hardness is measured in the following manner. For measurement, a nanoindenter ("ENT 1100a", manufactured by Elionix Inc.) was used. As an indenter for measuring the hardness, the Berkovich indenter was used, and the nanoindenter hardness was calculated from a load-displacement curve obtained under a predetermined measurement load. The measurement load is, in order to prevent the influence of a substrate for a material as an object to be measured, determined so that a pressing depth of the indenter is about 1/10 of the material as the object to be measured. Incidentally, it is difficult to measure the hardness of the nanoparticles themselves, and therefore all of hardness values of the particles used as the external additive were measured using the same materials in a film form or a plate form as alternatives thereto. In this embodiment, the measurement was made correspondingly to the thickness of the measuring material while selecting the measuring load between 0.1 mN and 5.0 mN. The measurement was made under an environment of 26° C. and 50% RH.

Therefore, in this embodiment, a constitution in which at least the surface hardness (nanoindenter hardness) of the developing blade 21 including the contact portion 21*a*1 with the developing roller 17 is higher than the hardness of the inorganic fine particles, on the toner surface, constituting an abrasion factor is employed.

Figure 9:
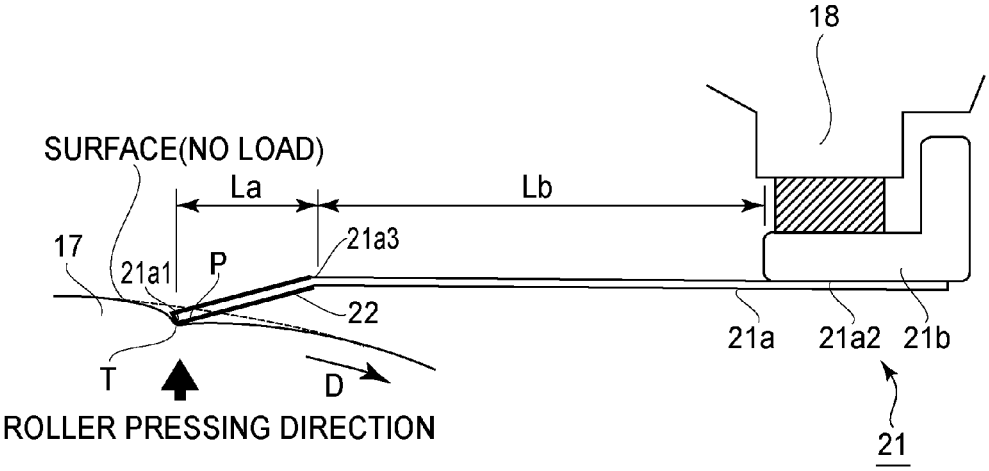
FIG. 9 is a schematic sectional view of a developing blade in Embodiment 6.

FIG. 9 is a schematic sectional view of a developing blade 21 in this embodiment. FIG. 9 shows a cross-section perpendicular to the rotational axis direction of the developing roller 17.

On the surface of the elastic member 21*a*, a surface layer 22 having a hardness higher than the hardness of the inorganic fine particles on the toner surface is provided at least in a region including the contact portion 21*a*1 with the developing roller 17. The surface layer 22 may preferably be provided only in the first region La. This is because when the surface layer 22 is provided in a region including the second region Lb, in the case where the developing blade 21 and the developing roller 17 are in contact with each other with a predetermined press-contact force, the elastic deformation of the elastic member 21*a* is prevented and thus stable elastic contact between the developing blade 21 and the developing roller 17 cannot be ensured. In this embodiment, the surface layer 22 was provided on all of the surfaces of the elastic member 21*a* in the first region La including the contact portion 21*a*1 with the developing roller 17. However, the present invention is not limited thereto. For example, a constitution in which the surface layer 22 is provided only in a region of the surface of the elastic member 21*a* in the first region La from the contact portion 21*a*1 with the developing roller 17 to a position opposing the developing roller 17 may also be employed.

The surface layer 22 is constituted by a single layer or a plurality of layers. As a structure of the single layer, it is possible to use a structure of a hard layer formed, on the surface of the elastic member 21*a*, of a material having a hardness higher than the hardness of the inorganic fine particles on the toner surface, such as DLC (diamond-like carbon), CrN, TiN, TiAlN, SiC. As a structure of the plurality of layers, it is possible to use a structure in which an intermediate layer or a layer having an inclined structure is provided between the hard layer and the surface of the elastic member 21*a* to improve a close-contact property between the hard layer and the surface of the elastic member 21*a*. A layer thickness of the surface layer 22 may preferably be 0.1-20 μm. This is because when the layer thickness is less than 0.1 μm, it becomes difficult to form a uniform film over the entire longitudinal region of the elastic member 21*a*, and when the layer thickness exceeds 20 μm, in some cases, the hard layer causes a crack due to the elastic deformation of the elastic member 21*a* and thus is liable to be peeled off.

In this embodiment, a 1.0 μm-thick surface layer 22 prepared by providing an intermediate layer of SiC on the surface of the elastic member 21*a* and then by forming a ta-C (hydrogen-free DLC) layer on the surface of the intermediate layer by an arc ion plating method is used. The arc ion plating method is such as a method that a target (film-forming material) is vaporized and ionized using vacuum arc discharge and thus the ions are deposited on a substrate. In this embodiment, as the film-forming material, solid carbon (graphite) was used, and film formation was effected at a treating temperature of 150° C. or less.

When the nanoindenter hardness of the DLC in this embodiment was measured, the hardness was about 55 GPa and thus was higher than the hardness of the inorganic fine particles, on the toner surface, constituting the abrasion factor. Therefore, even in the case where the developing unit 4 is used for a long term, a degree of the abrasion of the contact portion 21*a*1 of the developing blade 21 with the developing roller 17 can be reduced.

In this embodiment, the ta-C film formed by the arc ion plating method is used, but the present invention is not limited thereto. For example, as the species of the DLC, other species such as a-C, ta-C hydride, a-C hydride, GLC (glass-like carbon) may also be used. As the film-forming method, it is also possible to employ a sputtering method, an ionized deposition method, a low-temperature plasma ion implantation method, a plasma CVD method and so on.

In this embodiment, the surface layer 22 having the hardness higher than the hardness of the inorganic fine particles on the toner surface is provided on the surface of the elastic member 21*a* at least in the region including the contact portion 21*a*1 with the developing roller 17, but the present invention is not limited thereto. For example, the surface layer 22 may also be a surface layer increased in hardness of at least the region including the contact portion 21*a*1 of the elastic member 21*a* with the developing roller 17 by surface hardening treatment or another film treatment, or the like. Further, a constitution in which a thin plate formed of a material having a hardness higher than the hardness of the inorganic fine particles on the toner surface is used may also be employed.

As described above, according to this embodiment, not only an effect similar to that in Embodiment 1 can be obtained but also the degree of the abrasion of the contact portion 21*a*1 of the developing blade 21 with the developing roller 17 can be reduced, so that it becomes possible to further stably regulate the toner layer thickness for a long term. However, in general, the voltage applied to the developing blade 21 acts on the positively charged toner and the external additive charged to the same polarity as the normal charge polarity of the toner so as to peel off the toner and the external additive from the surface of the developing blade 21. When a surface resistance of the developing blade 21 is high, the action of the voltage applied to the developing blade 21 becomes weak, so that the toner and the external additive remain on the surface of the developing blade 21 while being deposited thereon and thus are liable to fuse. However, in this embodiment, the contact region between the developing blade 21 and the developing roller 17 are maintained in a narrow state, and therefore a degree of the sliding becomes strong in the neighborhood of the contact region by concentration of the press-contact force, so that even when the toner and the external additive are deposited on the surface of the developing blade 21, the toner and the external additive are liable to be peeled off.

<Embodiment 7>

Basic constitution and operation of an image forming apparatus in this embodiment are the same as those in Embodiment 6. Accordingly, in this embodiment, elements having the same or corresponding functions or constitutions as those in Embodiment 6 are represented by the same reference numerals or symbols and will be omitted from detailed description.

In this embodiment, a 1.0 μm-thick surface layer 22 prepared by providing an intermediate layer of SiC on the surface of the elastic member 21*a* and then by forming an a-C (hydrogen-free DLC) layer on the surface of the intermediate layer by the sputtering method is used. The sputtering method is such as a method that ions are caused to impact against a target (film-forming material) to eject the film-formed material and thus the film-forming material is deposited on a substrate. In this embodiment, as the film-forming material, solid carbon (graphite) was used, and film formation was effected at a treating temperature of about 200° C.

When the nanoindenter hardness of the DLC in this embodiment was measured, the hardness was about 23 GPa and thus was higher than the hardness of the inorganic fine particles, on the toner surface, constituting the abrasion factor. For that reason, an effect similar to that in Embodiment 6 can be obtained.

<Embodiment 8>

Other embodiments of the present invention will be described.

Basic constitution and operation of an image forming apparatus in each of Embodiment 8-1 to Embodiment 8-7 are the same as those in Embodiment 1. Accordingly, in this embodiment, elements having the same or corresponding functions or constitutions as those in Embodiment 1 are represented by the same reference numerals or symbols and will be omitted from detailed description.

In this embodiment, each of the species and amount of the inorganic fine particles to be deposited on the toner surface is changed.

In Embodiment 8-1, silicon oxide particles of about 20 nm in volume-average particle size, silicon oxide particles of about 10 nm and titanium oxide were deposited uniformly on the surface of the toner in amounts of about 1.5%, about 0.9% and about 0.1%, respectively, per the toner weight.

In Embodiment 8-2, silicon oxide particles of about 20 nm in volume-average particle size, and titanium oxide were deposited uniformly on the surface of the toner in amounts of about 1.8% and about 0.1%, respectively, per the toner weight.

In Embodiment 8-3, silicon oxide particles of about 20 nm in volume-average particle size, silicon oxide particles of about 50 nm and titanium oxide were deposited uniformly on the surface of the toner in amounts of about 1.5%, about 0.7% and about 0.1%, respectively, per the toner weight.

In Embodiment 8-4, silicon oxide particles of about 20 nm in volume-average particle size, silicon oxide particles of about 60 nm and titanium oxide were deposited uniformly on the surface of the toner in amounts of about 1.5%, about 0.8% and about 0.1%, respectively, per the toner weight.

In Embodiment 8-5, silicon oxide particles of about 20 nm in volume-average particle size, silicon oxide particles of about 100 nm and titanium oxide were deposited uniformly on the surface of the toner in amounts of about 1.5%, about 1.0% and about 0.1%, respectively, per the toner weight.

In Embodiment 8-6, silicon oxide particles of about 20 nm in volume-average particle size, silicon oxide particles of about 150 nm and titanium oxide were deposited uniformly on the surface of the toner in amounts of about 1.5%, about 2.0% and about 0.1%, respectively, per the toner weight.

In Embodiment 8-7, silicon oxide particles of about 20 nm in volume-average particle size, silicon oxide particles of about 100 nm and titanium oxide were deposited uniformly on the surface of the toner in amounts of about 1.5%, about 2.0% and about 0.1%, respectively, per the toner weight.

<Embodiment 9>

Basic constitution and operation of an image forming apparatus in this embodiment are the same as those in Embodiment 1. Accordingly, in this embodiment, elements having the same or corresponding functions or constitutions as those in Embodiment 1 are represented by the same reference numerals or symbols and will be omitted from detailed description.

In this embodiment, charge control particles are deposited on the toner surface and then are used. In the following, a manufacturing method and a deposition method of the charge control particles used in this embodiment will be described.

5. Manufacturing Method of Charge Control Particles

In a reaction container equipped with a cooling pipe, a stirring device, a thermometer and a nitrogen-introducing pipe, the following ingredients were placed.

| | |
|---|---|
| Styrene | 100.0 parts |
| 5-vinylsalicylate | 21.0 parts |
| Tert-butylperoxyisopropylcarbonate ("PERBUTYL I-75", manufactured by NOF Corp.) | 7.2 parts |
| Propylene glycol monomethyl ether acetate | 200.0 parts |

The ingredients were subjected to bubbling with nitrogen for 30 min. The reaction mixture was heated at 120° C. for 6 hours in a nitrogen atmosphere, so that polymerization reaction was completed. After the reaction liquid was cooled to room temperature, a solvent was distilled off under reduced pressure. The resultant solid was precipitated two times with acetone-methanol solvent, followed by drying under reduced pressure at 50° C. and 0.1 kPa or less, so that charge control particles were obtained.

Through $^{1}$H-NMR analysis and neutralization titration, it was confirmed that the above-obtained charge control particles contained 10 mol. % of 5-vinylsalicylate unit in entire monomer unit. Further, through size exclusion chromatography (SEC), a weight-average molecular weight (Mw) of the charge control particles was 14500.

Five parts of the charge control particles obtained above was dissolved in 8 parts of tetrahydrofuran (THF), and then 0.4 part of N,N-dimethyl-2-aminoethanol was added. Thereafter, to the mixture, 28 parts of pure water was gradually added dropwise while vigorously stirring the mixture at room temperature. From the resultant dispersion (dispersing liquid), THF was distilled off at 50° C. under reduced pressure, so that an aqueous dispersion of the charge control particles was obtained.

A solid content concentration of the dispersion was 20 wt. %, and number-average particle size of the charge control particles as measured by a dynamic light scattering method (using "Nanotrac", manufactured by Nikkiso Co., Ltd.) was 30 nm.

6. Deposition Step of Charge Control Particles on Toner

The toner particles were placed and dispersed in an aqueous solution of an anionic surfactant, so that a dispersion of 5.0 wt. % in solid content concentration was obtained. To 100.0 parts of the solid content of the above-obtained dispersion, 0.95 part of the aqueous dispersion of the charge control particles was added and stirred. To the mixture, diluted hydrochloric acid was added while stirring the mixture to adjust pH to 0.95, so that the charge control particles were agglomerated and fixed on the surfaces of the toner particles.

Thereafter, the dispersion is filtered off with a filter to remove water, and the residue was added into 120 parts of ion-exchanged water, followed by stirring to obtain a dispersion (dispersing liquid), and then the dispersion was subjected to solid-liquid separation using the filter. This operation was repeated three times, and then the particles finally subjected to the solid-liquid separation was sufficiently dried with a drier at 30° C., so that particles in which the charge control particles were deposited on the toner particles were obtained.

Thereafter, in a step similar to that in Embodiment 1, silicon oxide particles of about 20 nm in volume-average particle size and titanium oxide particles were uniformly deposited on the toner surface in amount of about 1.5% and about 0.1%, respectively, per the toner weight.

The charge control particles are not limited to those in this embodiment, but of known charge control particles, one species thereof can be used singly or two or more species thereof can be used in combination for adjusting a charging characteristic. As the species of the charge control particles, the following charge control particles can be used for example.

As the negatively chargeable charge control particles, it is possible to use particles of polymeric compounds having a sulfonic acid group, a sulfonic acid salt group or a sulfonate group; salicylic acid derivatives and metal complexes thereof; monoazo metal compounds; acetylacetone metal compounds; aromatic oxycarboxylic acids and aromatic mono- and poly-carboxylic acids and their metal salts, anhydrides, esters; phenolic derivatives such as bisphenol; urea derivatives; boron compounds; calixarene; and the like.

As the positively chargeable charge control particles, it is possible to use particles of nigrosine and nigrosine-modified substances with aliphatic acid metal salt; guanidine compounds; imidazole compounds; onium salts including quaternary ammonium salts such as tributylbenzylammonium-1-hydroxy-4-naphthosulfonate or tetrabutyl ammonium tetrafluoroborate, and phosphonium salts which are analogous salts thereof, and lake pigments of these salts; triphenylmethane dyes and lake pigments thereof (lake agent: phosphotungstic acid, phosphomolybdic acid, phosphotungstomolybric acid, tannic acid, lauric acid, gallic acid, ferricyanide, ferrocyanide, and the like); higher fatty acid metal salts; diorganotin oxides such as dibutyltin oxide, dioctyltin oxide or dicyclohexyltin oxide; diorganotin borates such as dibutyltin borate, dioctyltin borate or dicyclohexyltin borate; and so on.

<Embodiment 10>

Basic constitution and operation of an image forming apparatus in this embodiment are the same as those in Embodiment 1. Accordingly, in this embodiment, elements having the same or corresponding functions or constitutions as those in Embodiment 1 are represented by the same reference numerals or symbols and will be omitted from detailed description.

Figure 10:
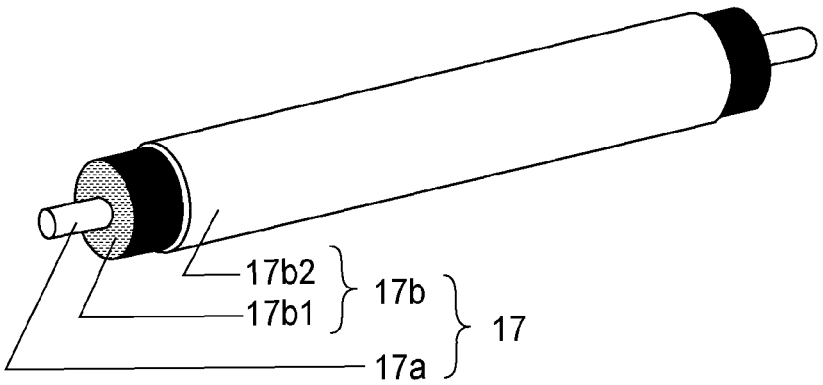
FIG. 10 is a perspective view showing a schematic structure of a developing roller in Embodiment 10.
Figure 11:
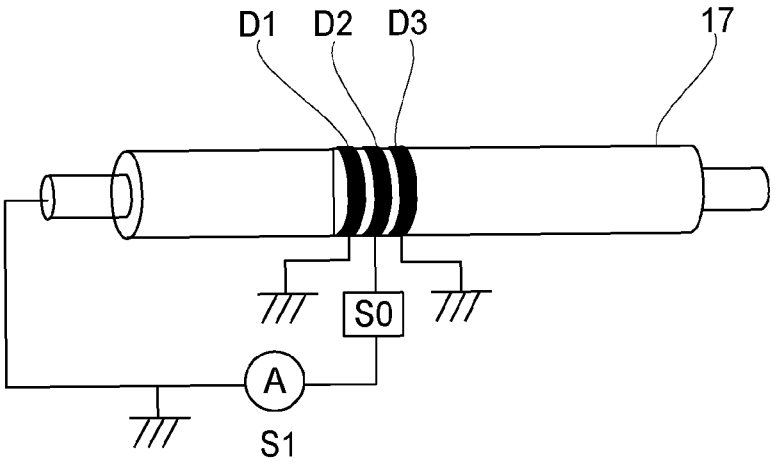
FIG. 11 is a schematic view for illustrating measurement of a resistivity of a developing roller in Embodiment 10.

As a developing roller 17 in this embodiment, a roller having the following constitution is used. FIG. 10 is a perspective view showing a general structure of the developing roller 17 in this embodiment. FIG. 11 is a schematic view for illustrating a measurement of a resistivity of the developing roller 17 in this embodiment.

The developing roller 17 in this embodiment includes an elastic layer and a surface layer formed around the elastic layer. The surface layer contains alumina and was provided so that a volume resistivity of the surface layer was higher than a volume resistivity of the elastic layer.

The alumina in this embodiment refers to aluminum oxide such as α-alumina or γ-alumina, aluminum oxide hydrate such as boehmite or pseudoboehmite, aluminum oxide, aluminum hydroxide, and an aluminum compound obtained by hydrolysis and condensation reaction of aluminum alkoxide described later. From the viewpoint of stability of a colloidal alumina solution, the alumina may preferably be boehmite or pseudoboehmite, and from the viewpoint of stability of formation of the surface layer, the alumina may preferably be the aluminum compound obtained by hydrolysis and condensation reaction of aluminum alkoxide described later. However, the alumina is not limited thereto, but known alumina may also be used.

In the following, a manufacturing method of the developing roller 17 will be described.

In this embodiment, around a core metal electrode 17*a* of 6 mm in outer diameter as an electroconductive support, an elastic layer 17*b* consisting of a base material 17*b*1 constituted by an electroconductive rubber layer or the like containing an electroconductive agent and an alumina surface layer 17*b*2 containing alumina is provided, so that the developing roller 17 of 12 mm in outer diameter was prepared. As a material for the rubber layer, it is possible to use a general-purpose rubber material such as silicone rubber, urethane rubber EPDM (ethylene-propylene copolymer) rubber, hydrin rubber or a rubber of a mixture thereof. In this embodiment, the base material 17*b*1 was prepared by forming a 3 mm-thick silicone rubber layer and a 10 μm-thick urethane layer. As the electroconductive agent, carbon black particles, metal particles, ion-conductive particles or the like are dispersed, so that a desired resistance value can be obtained. In this embodiment, the carbon black particles were used. By adjusting a silicone rubber amount and an amount of silica as a filler, a hardness of the developing roller 17 as a whole was adjusted, so that the developing roller 17 having a desired hardness was prepared. Then, a colloidal alumina solution was adjusted and the above-described base material 17*b*1 was dipped in the colloidal alumina solution, so that a 1.5 μm-thick alumina surface layer 17*b*2 was formed. As the colloidal alumina solution, a mixture of "ALUMINASOL 520" (manufactured by Nissan Chemical Industries, Ltd., average particle size: 20 nm, boehmite) with ethanol obtained by mixing and stirring in a volume ratio of 1:4 was used. In this embodiment, before the dipping, the surface of the base material 17*b*1 is subjected to UV irradiation, so that a coating property and an adhesive property of the colloidal alumina solution are improved. After the formation of the alumina surface layer 17*b*2, the resultant roller was dried at 140° C. for 15 min.

As the developing roller 17 in this embodiment, a roller having a resistance value of $5\times10^5$ Ω was used. In this embodiment, the resistivity of the alumina surface layer 17*b*2 is $5\times10^{11}$ Ωm, and the resistivity of the base material 17*b*1 is $1\times10^8$ ΩΩcm, so that the resistivity of the alumina surface layer 17*b*2 is higher than the resistivity of the base material 17*b*1.

The measurement of the resistivity of the developing roller 17 was made in the following manner. As shown in FIG. 11, an electroconductive tape of 5 mm in width is wound around the surface of the developing roller 17 at positions with an interval of 1 mm (electroconductive tapes D1, D2, D3). Of these 3 electroconductive tapes, between the electroconductive tape D2 positioned at a central portion and the core metal of the developing roller 17, a voltage described later is applied from a voltage source S0. The electroconductive tapes D1, D3 other than the central electroconductive tape D2 are grounded, and by detecting a current flowing through between the tape D2 and the developing roller 17 with an ammeter S1, the volume resistivity of the developing roller 17 with respect to a radial direction is determined. As the applied voltage, a voltage in the form of a DC voltage biased with an AC voltage is used. In this embodiment, the DC voltage of 20 V was biased with the AC voltage of 1 V in peak-to-peak voltage (Vpp) and 1 Hz to 1 MHz in frequency, and then a volume resistivity value of each of the layers was calculated from a Cole-Cole plot. The developing roller 17 was cut, and a cross-section thereof was subjected to measurement of thickness of each layer at 10 points through SEM observation to calculate an average thickness of each layer, so that the volume resistivity of each layer was derived from the volume resistance value of each layer. The measurement of the volume resistivity was made under an environment of 30° and 80% RH.

As a result of study by the present inventors, it was found that a good image can be obtained by making the resistivity of the alumina surface layer 17*b*2 higher than the resistivity of the base material 17*b*1.

First, an effect on a fluctuation in image density and gradation property will be described. In general, in order to obtain the image density and the gradation property, the resistivity of the base material 17*b*1 is adjusted so that a potential difference between the photosensitive drum and the developing roller during the image formation is a proper value. However, in this embodiment, the resistivity of the alumina surface layer 17*b*2 is provided so as to be higher than the resistivity of the base material 17*b*1, and therefore it would be considered that it is possible to suppress the fluctuation in image density and gradation property.

Figure 12:
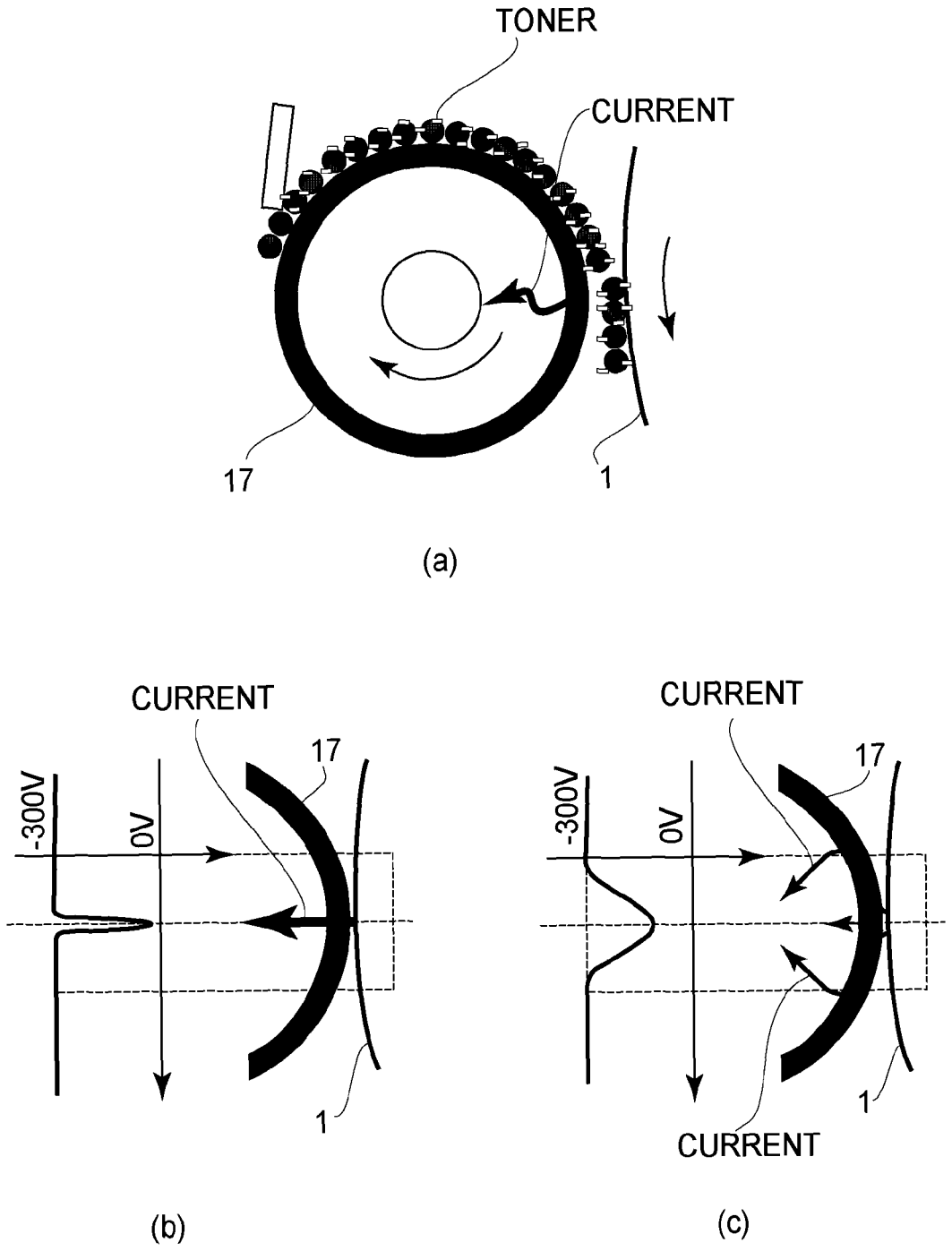
In FIG. 12, (a) to (c) are schematic views for illustrating a current path between a photosensitive drum and a developing roller during image formation.

Description will be made with reference to the drawings. In FIG. 12, (a), (b) and (c) are schematic views showing a current path between the photosensitive drum 1 and the developing roller 17 during the image formation. In FIG. 12, each of (a) to (c) shows a cross-section of the roller 17 with respect to the rotational axis direction.

As shown in (a) of FIG. 12, the toner on the developing roller 17 has electric charges. When the toner moves from the developing roller 17 onto the photosensitive drum 1 by the action of development, electric charges opposite in polarity to the polarity of the electric charges of the toner moves from the surface of the developing roller 17 toward the core metal of the developing roller 17 in a charge amount corresponding to a total charge amount of the toner.

In the case where the resistivity of the alumina surface layer 17*b*2 is provided so as to be lower than the resistivity of the base material 17*b*1, the current is liable to flow along the surface direction inside the alumina surface layer 17*b*2. As a result, a voltage drop before and behind the contact portion between the developing roller 17 and the photosensitive drum 1 becomes large to fluctuate electric field intensity, so that the image density and the gradation property change. When the thickness of the alumina surface layer 17*b*2 increases, the current flowing in the surface direction further increases in amount, so that a degree of the fluctuation in electric field intensity at the contact portion between the developing roller 17 and the photosensitive drum 1 further becomes large. On the other hand, in this embodiment, setting is made so that the resistivity of the alumina surface layer 17*b*2 is higher than the resistivity of the base material 17*b*1, and therefore as shown in (b) of FIG. 12, the current flowing in the surface direction can be suppressed. Therefore, the fluctuation in electric field intensity at the contact portion between the developing roller 17 and the photosensitive drum 1 can be suppressed, so that it is possible to obtain stable image density and gradation property. In order to suppress the current flowing in the surface direction of the alumina surface layer 17*b*2 and in order to suppress a remarkable increase in resistance value of the developing roller 17 as a whole, an average thickness of the alumina surface layer 17*b*2 may preferably be 5.0 μm or less. When the average thickness of the alumina surface layer 17*b*2 is larger than 5.0 μm, the current flowing in the surface direction of the alumina surface layer 17*b*2 can be suppressed, but the voltage drop of the alumina surface layer 17*b*2 becomes large. Therefore the intensity of the electric field exerted on the toner layer at the contact portion between the developing roller 17 and the photosensitive drum 1 lowers, so that the amount of the toner moving from the developing roller 17 onto the photosensitive drum 1 lowers, and thus the image density lowers.

An effect on attenuation of toner electric charges generating at the contact portion between the developing roller 17 and the photosensitive drum 1 will be described.

Figure 13:
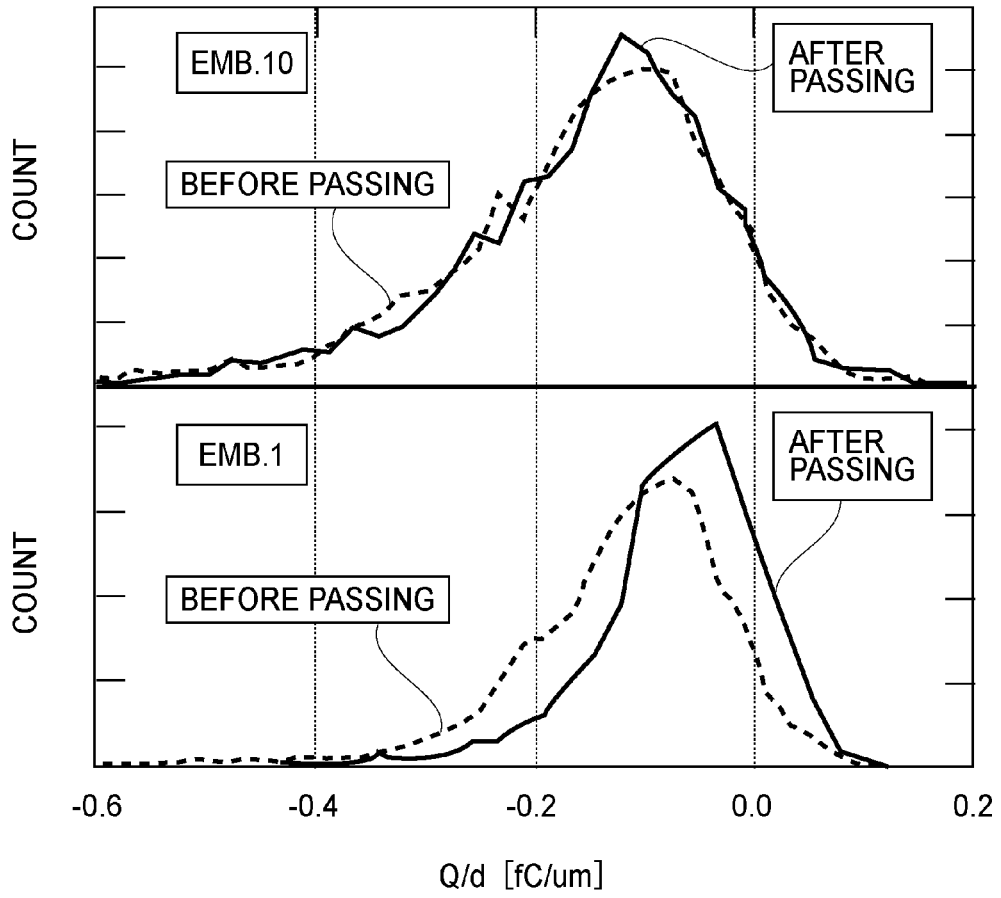
FIG. 13 is a graph showing an electric charge amount of a toner on a developing roller during solid white image formation.

FIG. 13 is a graph showing an electric charge distribution of the toner on the developing roller 17 during image formation of a solid white image. In an upper side, the electric charge distribution of the toner on the developing roller 17 in this embodiment (Embodiment 10) is shown, and in the lower side, the electric charge distribution of the toner on the developing roller 17 in Embodiment 1 is shown. In FIG. 13, the abscissa represents the toner charge amount Q/d (Q: charge amount of one toner particle, d: toner particle size), and the ordinate represents a count of the particles. In this embodiment and Embodiment 1, a main power switch was turned off during the solid white image formation and the electric charge amount distribution of the toner on the developing roller 17 each of before and after passing of the toner through the contact portion between the developing roller 17 and the photosensitive drum 1 was measured, so that a change in electric charge amount distribution due to the passing of the toner through the contact portion was evaluated. For measurement of the electric charge amount distribution, "E-SPART ANALYZER" (manufactured by Hosokawa Micron Corp.) was used.

As shown in FIG. 13, in this embodiment, the charge amount of the toner on the developing roller 17 each of before and after the passing of the toner through the contact portion between the developing roller 17 and the photosensitive drum 1 was higher than that in Embodiment 1. Further, in this embodiment, no attenuation of the electric charge amount of the toner on the developing roller 17 due to the passing of the toner through the contact portion between the developing roller 17 and the photosensitive drum 1 was not observed. This may be attributable to the following reason.

A degree of the toner electric charge amount attenuation is larger with an increasing intensity of the electric field formed between the developing roller 17 and the photosensitive drum 1. Further, the degree of the toner electric charge amount attenuation is larger with a longer time in which the toner on the developing roller 17 passes through the contact portion between the developing roller 17 and the photosensitive drum 1, i.e., a region where the intensity of the electric field formed between the developing roller 17 and the photosensitive drum 1 is large. In this embodiment, the resistance of the alumina surface layer 17*b*2 is high, and therefore it is possible to suppress an excessive increase in intensity of the electric field formed between the developing roller 17 and the photosensitive drum 1. Therefore, the toner electric charge amount attenuation can be suppressed. In order to obtain a toner electric charge amount attenuation-suppressing effect, the average thickness of the alumina surface layer 17*b*2 may preferably be 0.01 μm or more. This is because when the average thickness of the alumina surface layer 17*b*2 is less than 0.01 μm, the alumina surface layer 17*b*2 cannot sufficiently coat the base material 17*b*1, so that the toner electric charge amount attenuation cannot be suppressed in a region where a degree of the coating is insufficient.

In order to stably obtain the toner electric charge amount attenuation-suppressing effect and an image density fluctuation-suppressing effect, the average thickness of the alumina surface layer 17*b*2 may further preferably be 0.1 μm or more and 2.5 μm or less.

This is because when the average thickness is less than 0.1 μm, due to non-uniformity of the thickness of the alumina surface layer 17*b*2, the influence of the toner electric charge amount attenuation slightly appears. When the toner electric charges are lost at the contact portion between the developing roller 17 and the photosensitive drum 1, the toner cannot be controlled by the electric field, so that a so-called fog such that the toner transfers onto a non-image portion is liable to occur. This phenomenon is liable to be affected by the toner electric charge amount attenuation, and particularly in a high-humidity environment in which the electric charge amount attenuation is conspicuous, also the non-uniformity of the thickness of the alumina surface layer 17*b*2 is not negligible. On the other hand, when the average thickness is larger than 2.5 μm, a thick portion locally exists, so that a degree of uniformity of the image density slightly lowers in some cases.

The resistivity of the alumina surface layer 17*b*2 may preferably be $1\times10^{10}$ Ωcm or more and $1\times10^{14}$ Ωcm or less. This is because when the resistivity is less than $1\times10^{10}$ Ωcm, due to the thickness non-uniformity of the alumina surface layer 17*b*2, the influence of the toner electric charge amount attenuation is liable to generate. On the other hand, when the resistivity is larger than $1\times10^{14}$ Ωcm, the influence of the alumina surface layer 17*b*2 at the locally thick portion becomes large, so that the uniformity of the image density is liable to lower.

<Embodiment 11>

Basic constitution and operation of an image forming apparatus in this embodiment are the same as those in Embodiment 1. Accordingly, in this embodiment, elements having the same or corresponding functions or constitutions as those in Embodiment 1 are represented by the same reference numerals or symbols and will be omitted from detailed description.

In this embodiment, to the developing blade 21, a DC voltage of −300 V is applied. In other words, the developing blade 21 and the core metal of the developing roller 17 are provided in an equipotential state.

7. Comparison 2 Between Embodiments and Comparison Example

Description will be made in comparison between Embodiments 1 and 8-11 and Comparison Example. In each of constitutions in Embodiments and Comparison Example, evaluation of a vertical stripe when the developing unit 4 was used for a long term was made.

In this evaluation, first, the developing unit 4 is filled with the toner. After an A4-sized whole surface solid white image was intermittently printed on 1000 sheets, an A4-sized halftone image (density: 25%) was printed on one sheet. Thereafter, a step in which the A4-sized halftone image (density: 25%) was printed on one sheet every printing of the A4-sized whole surface solid white image on 500 sheets in an intermittent manner was repeated until an integrated print number reached 15000 sheets. Then, image evaluation was made by visual observation, and the integrated print number, of the whole surface solid white image, from which three or more vertical stripes were started to be recognized was evaluated. This evaluation was made by printing of the same (single) color under an environment of 15° C. and 10% RH.

An evaluation result is shown in Table 2.

TABLE 2

| | DB*1 | | DR*4 | Toner | | VSGSN*8 |
|---|---|---|---|---|---|---|
| | CN*2 | AV*3 | ASL*5 | SOPDA*6 | CCPD*7 | (sheets) |
| EMB. 1 | PI*9 | −500 | NO | 20 nm/1.5 wt % | NO | 10000 |
| EMB. 8-1 | PI*9 | −500 | NO | 20 nm/1.5 wt % + 10 nm/0.9 wt % | NO | 11000 |
| EMB. 8-2 | PI*9 | −500 | NO | 20 nm/1.8 wt % | NO | 10500 |
| EMB. 8-3 | PI*9 | −500 | NO | 20 nm/1.5 wt % + 50 nm/0.7 wt % | NO | 10500 |
| EMB. 8-4 | PI*9 | −500 | NO | 20 nm/1.5 wt % + 60 nm/0.8 wt % | NO | 12000 |
| EMB. 8-5 | PI*9 | −500 | NO | 20 nm/1.5 wt % + 100 nm/1.0 wt % | NO | 13000 |
| EMB. 8-6 | PI*9 | −500 | NO | 20 nm/1.5 wt % + 150 nm/2.0 wt % | NO | 14000 |
| EMB. 8-7 | PI*9 | −500 | NO | 20 nm/1.5 wt % + 100 nm/2.0 wt % | NO | 14000 |
| EMB. 9 | PI*9 | −500 | NO | 20 nm/1.5 wt % | YES | 12000 |
| EMB. 10 | PI*9 | −500 | YES | 20 nm/1.5 wt % | NO | 10500 |
| EMB. 11 | PI*9 | −300 | NO | 20 nm/1.5 wt % | NO | 12000 |
| COMP. EX. 1 | CC*10 | −500 | NO | 20 nm/1.5 wt % | NO | 8000 |

*1: "DB" is the developing blade.
*2: "CN" is the constitution.
*3: "AV" is the applied voltage (V).
*4: "DR" is the developing roller.
*5: "ASL" is the alumina surface layer.
*6: "SOPDA" is the silicon oxide particle deposition amount on the toner surface.
*7: "CCPD" is the charge control particle deposition on the toner surface.
*8: "VSGSN" is the vertical stripe generation sheet number (sheets).
*9: "PI" is the present invention.
*10: "CC" is the conventional constitution.

As shown in Table 2, in Embodiment 1, compared with Comparison Example 1, timing when the vertical stripes generated on the halftone image was later. This may be attributable to the following reason.

As a result of study by the present inventors, it was found that the toner resin or the like melt-sticking in the neighborhood of the contact portion between the developing blade 21 and the developing roller 17 prevented feeding of the toner at the contact portion and generated stripe-like non-uniformity with respect to the longitudinal direction of the developing roller 17.

In Comparison Example 2, in the case where the developing unit 4 is used for a long term, a degree of a change in shape due to abrasion of the contact portion 21*a*1 of the developing blade 21 with the developing roller 17 becomes large. Therefore, not only the contact region between the developing blade 21 and the developing roller 17 further extends, but also the press-contact force acting on the toner layer thickness regulation lowers. At this time, in a low press-contact force region, the toner in the neighborhood of the surface of the elastic member 21*a* is liable to stagnate and thus is liable to melt-stick on the surface of the elastic member 21*a* through deposition.

On the other hand, in Embodiment 1, even in the case where the developing unit 4 is used for a long term, the degree of a change in shape due to abrasion of the contact portion 21*a*1 of the developing blade 21 with the developing roller 17, i.e., a degree of a change in contact state can be made small. For that reason, a degree of a lowering in press-contact force acting on the toner layer thickness regulation is small, so that the toner in the neighborhood of the surface of the elastic member 21*a* does not readily stagnate. Therefore, it would be considered that the toner can be made so that the toner is not readily deposited and melt-stuck on the surface of the elastic member 21*a* and thus the timing of generation of the vertical stripes was able to be deferred.

In Embodiments 8-1 to 8-3, compared with Embodiment 1, it was possible to defer the timing of generation of vertical stripes on the halftone image. This may be attributable to the following reason.

In Embodiments 8-1 to 8-3, compared with Embodiment 1, the amount of the inorganic fine particles deposited on the toner surface is large (i.e., a surface coating ratio by the inorganic fine particles is large). For that reason, during sliding via the toner in the contact region between the developing blade 21 and the developing roller 17, an abrading force of the contact portion 21*a*1 of the developing blade 21 with the developing roller 17 becomes strong. Therefore, it would be considered that a cleaning effect for removing the toner or the like deposited on the surface of the elastic member 21*a* can be enhanced and thus the timing of generation of the vertical stripes due to the melt-sticking of the toner can be further deferred.

In Embodiments 8-4 to 8-7, compared with Embodiments 8-1 to 8-3, it was possible to defer the timing of generation of vertical stripes on the halftone image. This may be attributable to the following reason.

In Embodiments 8-4 to 8-7, compared with Embodiments 8-1 to 8-3, the volume-average particle size of the inorganic fine particles is 60 nm or more which is large. For that reason, during sliding via the toner in the contact region between the developing blade 21 and the developing roller 17, an abrading force of the contact portion 21*a*1 of the developing blade 21 with the developing roller 17 becomes further strong. Therefore, it would be considered that a cleaning effect for removing the toner or the like deposited on the surface of the elastic member 21*a* can be further enhanced and thus the timing of generation of the vertical stripes due to the melt-sticking of the toner can be further deferred. The effect is larger with a large volume-average particle size of the inorganic fine particles deposited on the toner surface. In the case where the volume-average particle size of the inorganic fine particles deposited on the toner surface is 60 nm or more which is large, comparison between Embodiment 8-5 and Embodiment 8-7 was made, so that study was made. Even in this case, when the amount of the inorganic fine particles deposited on the toner surface is large (i.e., when the coating ratio by the inorganic fine particles is high), the timing of generation of the vertical stripes on the halftone image was able to be deferred.

Also in Embodiment 9, the timing of generation of the vertical stripes on the halftone image was able to be made later than that in Embodiment 1. This may be attributable to the following reason.

In Embodiment 9, the charge control particles are deposited on the toner surface, so that a triboelectric charge amount of the toner is high. For that reason, a degree of retention of the toner on the developing roller 17 by a mirror force becomes strong, so that a toner feeding force by movement of the surface of the developing roller 17 becomes strong. In other words, in the contact region between the developing blade 21 and the developing roller 17, the toner in the neighborhood of the surface of the elastic member 21*a* does not readily stagnate. Therefore, it would be considered that the toner can be made so that the toner is not readily deposited and melt-stuck on the surface of the elastic member 21*a*and thus the timing of generation of the vertical stripes was able to be deferred.

Also in Embodiment 10, the timing of generation of the vertical stripes on the halftone image was able to be made later than that in Embodiment 1. This may be attributable to the following reason.

In Embodiment 10, the developing roller 17 is provided with the alumina surface layer 17*b*2, so that the charge amount of the toner is high. Therefore, similarly as in Embodiment 9, it would be considered that the toner can be made so that the toner is not readily deposited and melt-stuck on the surface of the elastic member 21*a* and thus the timing of generation of the vertical stripes was able to be deferred.

Also in Embodiment 11, the timing of generation of the vertical stripes on the halftone image was able to be made later than that in Embodiment 1. This may be attributable to the following reason.

In Embodiment 11, the DC voltage of −300 V is applied the developing blade 21, so that the developing blade 21 and the core metal of the developing roller 17 are provided in an equipotential state. For that reason, in the contact region between the developing blade 21 and the developing roller 17, a degree of the deposition of the toner low in charge amount and the reversely charged toner which are attracted to the surface of the elastic member 21*a* due to the potential difference between the developing blade 21 and the developing roller 17 is reduced. Therefore, it would be considered that the toner can be made so that the toner is not readily deposited and melt-stuck on the surface of the elastic member 21*a* and thus the timing of generation of the vertical stripes was able to be deferred.

As described above, according to Embodiments 8 to 11, not only the effect similar to that in Embodiment 1 but also it is possible to suppress the deposition and melt-sticking of the toner on the surface of the elastic member 21*a*. Therefore, a higher-quality image can be outputted for a long term.

<Other Embodiments>

The present invention was described above based on specific embodiment, but is not limited to the above-described embodiments.

For example, in the above-described embodiments, the photosensitive drum and the toner which have the negative polarity as the normal charge polarity are used, but the present invention is not limited thereto. The photosensitive drum and the toner which have the positive polarity as the normal charge polarity may also be used. In that case, there is a need to change the polarity of the voltage applied to each of the respective parts such as the charging roller and the developing roller, as desired. A person ordinarily skilled in the art can easily make such a change.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Applications Nos. 2014-214070 filed on Oct. 20, 2014 and 2015-161353 filed on Aug. 18, 2015, which are hereby incorporated by reference herein in their entirety.

What is claimed is:

1. A developing device comprising:

a developing container for accommodating developer;

a developer carrying member, provided rotatably in said developing container, for carrying and feeding the developer; and a plate-like elastic member, supported by said developing container, for regulating the developer carried on said developer carrying member, wherein a free end portion of said elastic member in a free end side opposite from a side where a supporting portion of said elastic member is supported by said developing container contacts said developer carrying member in a state in which the free end portion is directed toward an upstream side of said developer carrying member with respect to a movement direction of said developer carrying member, wherein in a state in which said elastic member contacts said developer carrying member without being deformed, an angle formed between a flat reference surface passing through a surface of said elastic member which is continuous to a contact portion of said elastic member with said developer carrying member and which is downstream of the contact portion with respect to the movement direction and a tangent plane of said developer carrying member at a contact position between said elastic member and said developer carrying member is 10° or more and 45° or less, and wherein said elastic member includes a first region including the contact portion and a second region which is provided continuously from the first region toward the supporting portion and which is lower in rigidity than the first region, the second region being provided downstream of the flat reference surface with respect to the movement direction.

2. A developing device according to claim 1, wherein said elastic member is formed with a plate-like member bent in at least one position between the supporting portion and the free end portion with respect to a free length direction.

3. A developing device according to claim 2, wherein the second region is a region of said elastic member from the supporting portion to a closest bent portion to the supporting portion with respect to the free length direction, and the first region is a region of said elastic member from the bent portion to the roller end portion with respect to the free length direction, and wherein with respect to the free length direction, a length of the second region is longer than a length of the first region.

4. A developing device according to claim 3, wherein said elastic member includes a bent portion bent in a position between the supporting portion and the free end portion with respect to the free length direction, and wherein the bent portion is bent outwardly in an opposite side from said developer carrying member.

5. A developing device according to claim 3, wherein said elastic member is bent in at least two positions between the supporting portion and the free end portion with respect to the free length direction, and wherein with respect to the free length direction, the closest bent portion to the supporting portion is bent inwardly toward said developer carrying member, and a closest bent portion to the free end portion is bent outwardly relative to said developer carrying member.

6. A developing device according to claim 3, wherein in the first region, said elastic member has an outwardly curved surface in an opposite side from said developer carrying member.

7. A developing device according to claim 1, wherein said elastic member is fixedly supported by said developing container.

8. A developing device according to claim 1, wherein said elastic member is rotatably supported by said developing container, and wherein said developing device further comprises urging means for urging said elastic member against said developer carrying member by rotating said elastic member.

9. A developing device according to claim 8, further comprising a supporting member to support said elastic member, with said supporting member formed with a plate-like member thicker than said elastic member, and wherein said urging means urges said elastic member via said supporting member.

10. A developing device according to claim 1, wherein the developer is provided with at least one species of an inorganic substance at a surface thereof.

11. A developing device according to claim 10, wherein the inorganic substance is inorganic fine particles.

12. A developing device according to claim 10, wherein of said at least one species of the inorganic substance, at least one species of the inorganic substance is inorganic fine particles of not less than 60 nm in volume-average particle size.

13. A developing device according to claim 10, wherein when a hardness of the inorganic substance is measured by a nanoindentation method, a hardness of said elastic member at least in a region contacting said developer carrying member is higher than the hardness of the inorganic substance.

14. A developing device according to claim 1, wherein the developer is provided with at least one species of charge control particles at a surface thereof.

15. A developing device according to claim 1, wherein said developer carrying member includes an elastic layer.

16. A developing device according to claim 15, wherein said developer carrying member includes a surface layer containing alumina around the elastic layer, said surface layer having a volume resistivity higher than a volume resistivity of the elastic layer.

17. A developing device according to claim 1, further comprising a supporting member for supporting said developer carrying member and said elastic member equipotentially.

18. A developing device according to claim 1, wherein said elastic member is formed by subjecting a metal plate to press work, and wherein said contact portion is constituted by a curved surface of a shear droop portion formed by the press work.

19. A developing device according to claim 1, wherein the developer is a non-magnetic one-component developer or a magnetic one-component developer.

20. A process cartridge detachably mountable to a main assembly of an image forming apparatus, comprising:

an image bearing member on which an electrostatic latent image is formed; and a developing device, wherein said developing device comprises, a developing container for accommodating developer;

a developer carrying member, provided rotatably in said developing container, for carrying and feeding the developer, and a plate-like elastic member, supported by said developing container, for regulating the developer carried on said developer carrying member, wherein a free end portion of said elastic member in a free end side opposite from a side where a supporting portion of said elastic member is supported by said developing container contacts said developer carrying member in a state in which the free end portion is directed toward an upstream side of said developer carrying member with respect to a movement direction of said developer carrying member, wherein in a state in which said elastic member contacts said developer carrying member without being deformed, an angle formed between a flat reference surface passing through a surface of said elastic member which is continuous to a contact portion of said elastic member with said developer carrying member and which is downstream of the contact portion with respect to the movement direction and a tangent plane of said developer carrying member at a contact position between said elastic member and said developer carrying member is 10° or more and 45° or less, and wherein said elastic member includes a first region including the contact portion and a second region which is provided continuously from the first region toward the supporting portion and which is lower in rigidity than the first region, the second region being provided downstream of the flat reference surface with respect to the movement direction.

21. A process cartridge according to claim 20, wherein said elastic member is formed with a plate-like member bent in at least one position between the supporting portion and the free end portion with respect to a free length direction.

22. A process cartridge according to claim 21, wherein the second region is a region of said elastic member from the supporting portion to a closest bent portion to the supporting portion with respect to the free length direction, and the first region is a region of said elastic member from the bent portion to the roller end portion with respect to the free length direction, and wherein with respect to the free length direction, a length of the second region is longer than a length of the first region.

23. A process cartridge according to claim 22, wherein said elastic member includes a bent portion bent in a position between the supporting portion and the free end portion with respect to the free length direction, and wherein the bent portion is bent outwardly in an opposite side from said developer carrying member.

24. A process cartridge according to claim 22, wherein said elastic member is bent in at least two positions between the supporting portion and the free end portion with respect to the free length direction, and wherein with respect to the free length direction, the closest bent portion to the supporting portion is bent inwardly toward said developer carrying member, and a closest bent portion to the free end portion is bent outwardly relative to said developer carrying member.

25. A process cartridge according to claim 22, wherein in the first region, said elastic member has an outwardly curved surface in an opposite side from said developer carrying member.

26. A process cartridge according to claim 20, wherein said elastic member is fixedly supported by said developing container.

27. A process cartridge according to claim 20, wherein said elastic member is rotatably supported by said developing container, and wherein said developing device further comprises urging means for urging said elastic member against said developer carrying member by rotating said elastic member.

28. A process cartridge according to claim 27, further comprising a supporting member to support said elastic member, with said supporting member formed with a plate-like member thicker than said elastic member, and wherein said urging means urges said elastic member via said supporting member.

29. A process cartridge according to claim 20, wherein the developer is provided with at least one species of an inorganic substance at a surface thereof.

30. A process cartridge according to claim 29, wherein the inorganic substance is inorganic fine particles.

31. A process cartridge according to claim 29, wherein of said at least one species of the inorganic substance, at least one species of the inorganic substance is inorganic fine particles of not less than 60 nm in volume-average particle size.

32. A process cartridge according to claim 29, wherein when a hardness of the inorganic substance is measured by a nanoindentation method, a hardness of said elastic member at least in a region contacting said developer carrying member is higher than the hardness of the inorganic substance.

33. A process cartridge according to claim 20, wherein the developer is provided with at least one species of charge control particles at a surface thereof.

34. A process cartridge according to claim 20, wherein said developer carrying member includes an elastic layer.

35. A process cartridge according to claim 34, wherein said developer carrying member includes a surface layer containing alumina around the elastic layer, said surface layer having a volume resistivity higher than a volume resistivity of the elastic layer.

36. A process cartridge according to claim 20, further comprising a supporting member for supporting said developer carrying member and said elastic member equipotentially.

37. A process cartridge according to claim 20, wherein said elastic member is formed by subjecting a metal plate to press work, and wherein said contact portion is constituted by a curved surface of a shear droop portion formed by the press work.

38. A process cartridge according to claim 20, wherein the developer is a non-magnetic one-component developer or a magnetic one-component developer.

39. An image forming apparatus for forming an image on a recording material, comprising:

an image bearing member on which an electrostatic latent image is formed; and a developing device, wherein said developing device comprises, a developing container for accommodating developer;

a developer carrying member, provided rotatably in said developing container, for carrying and feeding the developer, and a plate-like elastic member, supported by said developing container, for regulating the developer carried on said developer carrying member, wherein a free end portion of said elastic member in a free end side opposite from a side where a supporting portion of said elastic member is supported by said developing container contacts said developer carrying member in a state in which the free end portion is directed toward an upstream side of said developer carrying member with respect to a movement direction of said developer carrying member, wherein in a state in which said elastic member contacts said developer carrying member without being deformed, an angle formed between a flat reference surface passing through a surface of said elastic member which is continuous to a contact portion of said elastic member with said developer carrying member and which is downstream of the contact portion with respect to the movement direction and a tangent plane of said developer carrying member at a contact position between said elastic member and said developer carrying member is 10° or more and 45° or less, and wherein said elastic member includes a first region including the contact portion and a second region which is provided continuously from the first region toward the supporting portion and which is lower in rigidity than the first region, the second region being provided downstream of the flat reference surface with respect to the movement direction.

40. An image forming apparatus according to claim 39, wherein said elastic member is formed with a plate-like member bent in at least one position between the supporting portion and the free end portion with respect to a free length direction.

41. An image forming apparatus according to claim 40, wherein the second region is a region of said elastic member from the supporting portion to a closest bent portion to the supporting portion with respect to the free length direction, and the first region is a region of said elastic member from the bent portion to the roller end portion with respect to the free length direction, and wherein with respect to the free length direction, a length of the second region is longer than a length of the first region.

42. An image forming apparatus according to claim 41, wherein said elastic member includes a bent portion bent in a position between the supporting portion and the free end portion with respect to the free length direction, and wherein the bent portion is bent outwardly in an opposite side from said developer carrying member.

43. An image forming apparatus according to claim 41, wherein said elastic member is bent in at least two positions between the supporting portion and the free end portion with respect to the free length direction, and wherein with respect to the free length direction, the closest bent portion to the supporting portion is bent inwardly toward said developer carrying member, and a closest bent portion to the free end portion is bent outwardly relative to said developer carrying member.

44. An image forming apparatus according to claim 41, wherein in the first region, said elastic member has an outwardly curved surface in an opposite side from said developer carrying member.

45. An image forming apparatus according to claim 39, wherein said elastic member is fixedly supported by said developing container.

46. An image forming apparatus according to claim 39, wherein said elastic member is rotatably supported by said developing container, and wherein said developing device further comprises urging means for urging said elastic member against said developer carrying member by rotating said elastic member.

47. An image forming apparatus according to claim 46, further comprising a supporting member to support said elastic member, with said supporting member formed with a plate-like member thicker than said elastic member, and wherein said urging means urges said elastic member via said supporting member.

48. An image forming apparatus according to claim 39, wherein the developer is provided with at least one species of an inorganic substance at a surface thereof.

49. An image forming apparatus according to claim 48, wherein the inorganic substance is inorganic fine particles.

50. An image forming apparatus according to claim 48, wherein of said at least one species of the inorganic substance, at least one species of the inorganic substance is inorganic fine particles of not less than 60 nm in volume-average particle size.

51. An image forming apparatus according to claim 48, wherein when a hardness of the inorganic substance is measured by a nanoindentation method, a hardness of said elastic member at least in a region contacting said developer carrying member is higher than the hardness of the inorganic substance.

52. An image forming apparatus according to claim 39, wherein the developer is provided with at least one species of charge control particles at a surface thereof.

53. An image forming apparatus according to claim 39, wherein said developer carrying member includes an elastic layer.

54. An image forming apparatus according to claim 53, wherein said developer carrying member includes a surface layer containing alumina around the elastic layer, said surface layer having a volume resistivity higher than a volume resistivity of the elastic layer.

55. An image forming apparatus according to claim 39, further comprising a supporting member for supporting said developer carrying member and said elastic member equipotentially.

56. An image forming apparatus according to claim 39, wherein said elastic member is formed by subjecting a metal plate to press work, and wherein said contact portion is constituted by a curved surface of a shear droop portion formed by the press work.

57. An image forming apparatus according to claim 39, wherein the developer is a non-magnetic one-component developer or a magnetic one-component developer.

* * * * *